US009002711B2

(12) United States Patent
Morinaka et al.

(10) Patent No.: US 9,002,711 B2
(45) Date of Patent: Apr. 7, 2015

(54) SPEECH SYNTHESIS APPARATUS AND METHOD

(75) Inventors: Ryo Morinaka, Tokyo (JP); Takehiko Kagoshima, Yokohama (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 160 days.

(21) Appl. No.: 12/970,162

(22) Filed: Dec. 16, 2010

(65) Prior Publication Data

US 2011/0087488 A1 Apr. 14, 2011

Related U.S. Application Data

(63) Continuation of application No. PCT/JP2010/054250, filed on Mar. 12, 2010.

(30) Foreign Application Priority Data

Mar. 25, 2009 (JP) ..... 2009-074707

(51) Int. Cl.
*G10L 13/06* (2013.01)
*G10L 13/033* (2013.01)
(Continued)

(52) U.S. Cl.
CPC ..... *G10L 13/06* (2013.01); *G10L 13/033* (2013.01); *G10L 19/097* (2013.01); *G10L 25/15* (2013.01); *G10L 2021/0135* (2013.01)

(58) Field of Classification Search
CPC ..... G10L 13/033
USPC ..... 704/258–261, 265–269
See application file for complete search history.

(56) References Cited

U.S. PATENT DOCUMENTS 6,366,883 B1 * 4/2002 Campbell et al. ..... 704/260
6,442,519 B1 * 8/2002 Kanevsky et al. ..... 704/243
(Continued)

FOREIGN PATENT DOCUMENTS

JP 2951514 7/1999
JP 2005-43828 2/2005
(Continued)

OTHER PUBLICATIONS

Tatzuya Mizutani, "*Speech Synthesis based on Selection and Fusion of a Multiple Unit*"; The 2004 Spring Meeting of the Acoustical Society of Japan, Koen Ronbunshu-I-, Mar. 2004, pp. 217-218.
(Continued)

*Primary Examiner* — Douglas Godbold
(74) *Attorney, Agent, or Firm* — Ohlandt, Greeley, Ruggiero & Perle, L.L.P.

(57) ABSTRACT

According to an embodiment, a speech synthesis apparatus includes a selecting unit configured to select speaker's parameters one by one for respective speakers and obtain a plurality of speakers' parameters, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms. The apparatus includes a mapping unit configured to make formants correspond to each other between the plurality of speakers' parameters using a cost function based on the formant frequencies and the formant powers. The apparatus includes a generating unit configured to generate an interpolated speaker's parameter by interpolating, at desired interpolation ratios, the formant frequencies, formant phases, formant powers, and window functions of formants which are made to correspond to each other.

13 Claims, 20 Drawing Sheets

(51) Int. Cl.

| | |
|---|---|
| *G10L 19/097* | (2013.01) |
| *G10L 25/15* | (2013.01) |
| *G10L 21/013* | (2013.01) |

(56) References Cited

U.S. PATENT DOCUMENTS

| | | | | |
|---|---|---|---|---|
| 7,251,601 | B2 | 7/2007 | Kagoshima et al. | 704/268 |
| 7,716,052 | B2 * | 5/2010 | Aaron et al. | 704/258 |
| 2002/0120450 | A1 * | 8/2002 | Junqua et al. | 704/258 |
| 2005/0065795 | A1 * | 3/2005 | Mutsuno et al. | 704/260 |
| 2005/0182629 | A1 * | 8/2005 | Coorman et al. | 704/266 |
| 2006/0259303 | A1 * | 11/2006 | Bakis | 704/268 |
| 2006/0271367 | A1 * | 11/2006 | Hirabayashi et al. | 704/261 |
| 2009/0048841 | A1 * | 2/2009 | Pollet et al. | 704/260 |
| 2009/0177474 | A1 * | 7/2009 | Morita et al. | 704/260 |
| 2010/0250257 | A1 * | 9/2010 | Hirose et al. | 704/278 |

FOREIGN PATENT DOCUMENTS

| | | |
|---|---|---|
| JP | 3732793 | 10/2005 |
| JP | 2009-216723 | 9/2009 |

OTHER PUBLICATIONS

Ryo Morinaka, "*Speech Synthesis based on the Plural Unit Selection and Fusion Method Using FWF Model*"; IEICE Technical Report, Jan. 2009, vol. 108, No. 422, pp. 67-72.

International Search Report from PCT/JP2010/054250 dated May 11, 2010.

* cited by examiner

| Phoneme | Number of speech segments | Speech segment ID | Number of frames | Frame ID | Number of formants | Formant ID | Formant frequency | Formant phase | Formant power | Window function |
|---|---|---|---|---|---|---|---|---|---|---|
| /a/ | 7231 | 1 | 10 | 1 | 8 | 1 | 0.080497 | 0.639213 | 827.910583 |  |
| | | | | | | 2 | 0.245731 | 0.096710 | 479.936066 |  |
| | | | | | | 3 | 0.654918 | 0.860374 | 119.966652 |  |
| | | | | | | ⋮ | ⋮ | ⋮ | ⋮ | ⋮ |
| | | | | ⋮ | ⋮ | ⋮ | ⋮ | ⋮ | ⋮ | ⋮ |
| | | ⋮ | ⋮ | ⋮ | ⋮ | ⋮ | ⋮ | ⋮ | ⋮ | ⋮ |

431

| Formant ID | Speaker X | Speaker Y |
|---|---|---|
| 1 | -1 | -1 |
| 2 | -1 | -1 |
| 3 | -1 | -1 |
| 4 | -1 | -1 |
| 5 | -1 | -1 |
| 6 | -1 | -1 |
| 7 | -1 | -1 |
| 8 | -1 | -1 |
| 9 | -1 | |

FIG. 7

431

| Formant ID | Speaker X | Speaker Y |
|---|---|---|
| 1 | 1 | 1 |
| 2 | 2 | 2 |
| 3 | -1 | 4 |
| 4 | 3 | 5 |
| 5 | 4 | 6 |
| 6 | 5 | 7 |
| 7 | 6 | 9 |
| 8 | -1 | -1 |
| 9 | 7 | |

FIG. 8

SPEECH SYNTHESIS APPARATUS AND METHOD

CROSS-REFERENCE TO RELATED APPLICATIONS

This is a Continuation Application of PCT Application No. PCT/JP2010/054250, filed Mar. 12, 2010, which was published under PCT Article 21(2) in Japanese.

This application is based upon and claims the benefit of priority from prior Japanese Patent Application No. 2009-074707, filed Mar. 25, 2009, the entire contents of which are incorporated herein by reference.

FIELD

Embodiments described herein relate generally to text-to-speech synthesis.

BACKGROUND

A technique of artificially generating a speech signal from an arbitrary document (text) is called text-to-speech synthesis. The text-to-speech synthesis is implemented by three steps, i.e., language processing, prosodic processing, and speech signal synthesis processing.

In language processing serving as the first step, an input text undergoes morphological analysis, syntax analysis, and the like. In prosodic processing serving as the second step, processing regarding the accent and intonation is performed based on the language processing result, outputting a phoneme sequence (phoneme symbol sequence) and prosodic information (e.g., fundamental frequency, phoneme duration, and power). Finally in speech signal synthesis processing serving as the third step, a speech signal is synthesized based on the phoneme sequence and prosodic information.

The basic principle of a kind of text-to-speech synthesis is to connect feature parameters called speech segments. The speech segment is the feature parameter of relatively short speech such as CV, CVC, or VCV (C is a consonant and V is a vowel). An arbitrary phoneme symbol sequence can be synthesized by connecting prepared speech segments while controlling the pitch and duration. In the text-to-speech synthesis, the quality of usable speech segments greatly influences that of synthesized speech.

A speech synthesis method described in Japanese Patent Publication No. 3732793 expresses a speech segment using, e.g., a formant frequency. In this speech synthesis method, a waveform representing one formant (to be simply referred to as a formant waveform) is generated by multiplying a sine wave having the same frequency as the formant frequency by a window function. A plurality of formant waveforms are superposed (added), synthesizing a speech signal. The speech synthesis method in Japanese Patent Publication No. 3732793 can directly control the phoneme or voice quality and thus can relatively easily implement flexible control such as changing the voice quality of synthesized speech.

The speech synthesis method described in Japanese Patent Publication No. 3732793 can shift the formant to a high-frequency side to make the voice of synthesized speech thin or shift it to a low-frequency side to make the voice of synthesized speech deep by converting all formant frequencies contained in speech segments using a control function for changing the depth of a voice. However, the speech synthesis method described in Japanese Patent Publication No. 3732793 does not synthesize interpolated speech based on a plurality of speakers.

A speech synthesis apparatus described in Japanese Patent Publication No. 2951514 generates interpolated speech spectrum data by interpolating speech spectrum data of a plurality of speakers using predetermined interpolation ratios. The speech synthesis apparatus described in Japanese Patent Publication No. 2951514 can control the voice quality of synthesized speech using even a relatively simple arrangement.

The speech synthesis apparatus described in Japanese Patent Publication No. 2951514 synthesizes interpolated speech based on a plurality of speakers, but the quality of the interpolated speech is not always high because of its simple arrangement. In particular, the speech synthesis apparatus described in Japanese Patent Publication No. 2951514 may not obtain interpolated speech with satisfactory quality upon interpolating a plurality of speech spectrum data differing in formant position (formant frequency) or the number of formants.

BRIEF DESCRIPTION OF THE DRAWINGS

FIG. 7 is a table showing an example of a mapping result at the start of mapping processing in FIG. 6;

FIG. 8 is a table showing an example of a mapping result at the end of mapping processing in FIG. 6;

DETAILED DESCRIPTION

In general, according to one embodiment, a speech synthesis apparatus includes a selecting unit configured to select speaker's parameters one by one for respective speakers and obtain a plurality of speakers' parameters, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms. The apparatus includes a mapping unit configured to make formants correspond to each other between the plurality of speakers' parameters using a cost function based on the formant frequencies and the formant powers. The apparatus includes a generating unit configured to generate an interpolated speaker's parameter by interpolating, at desired interpolation ratios, the formant frequencies, formant phases, formant powers, and window functions of formants which are made to correspond to each other. The apparatus includes a synthesizing unit configured to synthesize a pitch waveform corresponding to interpolated speaker's speech sounds based on the interpolation ratios using the interpolated speaker's parameter.

Embodiments will be described in detail below with reference to the accompanying drawing.

First Embodiment

Figure 1:
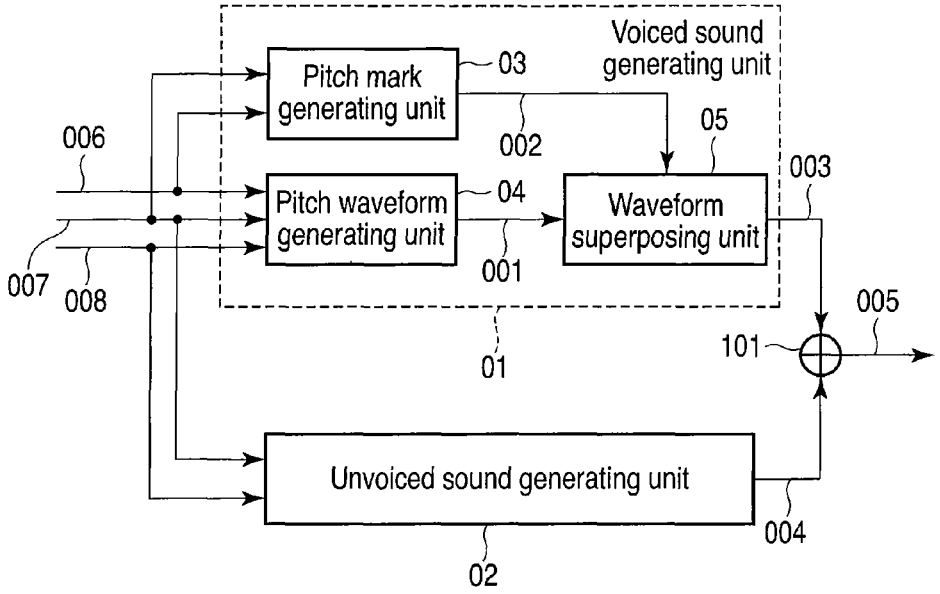
FIG. 1 is a block diagram showing a speech synthesis apparatus according to the first embodiment.

As shown in FIG. 1, a speech synthesis apparatus according to the first embodiment includes a voiced sound generating unit 01, unvoiced sound generating unit 02, and adder 101.

The unvoiced sound generating unit 02 generates an unvoiced sound signal 004 based on a phoneme duration 007 and phoneme symbol sequence 008, and inputs it to the adder 101. For example, when a phoneme contained in the phoneme symbol sequence 008 indicates an unvoiced consonant or voiced friction sound, the unvoiced sound generating unit 02 generates an unvoiced sound signal 004 corresponding to the phoneme. A concrete arrangement of the unvoiced sound generating unit 02 is not particularly limited. For example, an arrangement for exciting LPC synthesis filter by white noise is applicable, or another existing arrangement is also applicable singly or in combination.

The voiced sound generating unit 01 includes a pitch mark generating unit 03, pitch waveform generating unit 04, and waveform superposing unit 05 (all of which will be described below). The voiced sound generating unit 01 receives a pitch pattern 006, the phoneme duration 007, and the phoneme symbol sequence 008. The voiced sound generating unit 01 generates a voiced sound signal 003 based on the pitch pattern 006, phoneme duration 007, and phoneme symbol sequence 008, and inputs it to the adder 101.

Figure 2:
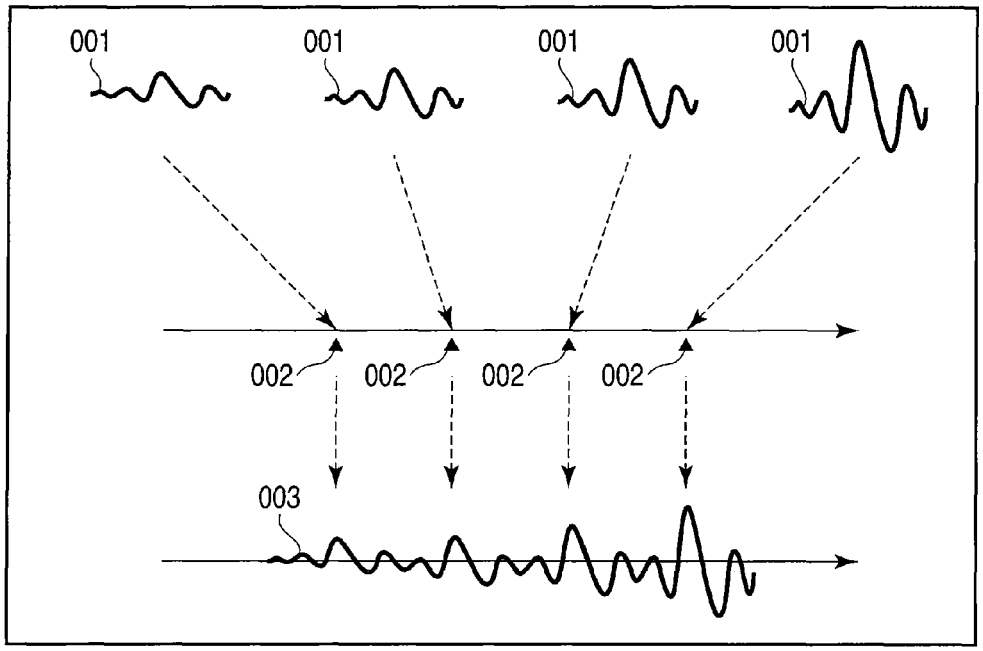
FIG. 2 is a view showing generation processing performed by a voiced sound generating unit in FIG. 1.

The pitch mark generating unit 03 generates pitch marks 002 based on the pitch pattern 006 and phoneme duration 007, and inputs them to the waveform superposing unit 05. The pitch mark 002 is information indicating a time position for superposing each pitch waveform 001, as shown in FIG. 2. The interval between adjacent pitch marks 002 is equivalent to the pitch cycle.

The pitch waveform generating unit 04 generates the pitch waveforms 001 (see, e.g., FIG. 2) based on the pitch pattern 006, phoneme duration 007, and phoneme symbol sequence 008. Details of the pitch waveform generating unit 04 will be described later.

The waveform superposing unit 05 superposes pitch waveforms corresponding to the pitch marks 002 on time positions indicated by the pitch marks 002 (see, e.g., FIG. 2), generating the voiced speech signal 003. The waveform superposing unit 05 inputs the voiced sound signal 003 to the adder 101.

The adder 101 adds the voiced sound signal 003 and unvoiced sound signal 004, generating a synthesized speech signal 005. The adder 101 outputs the synthesized speech signal 005 to an output control unit (not shown) which controls an output unit (not shown) formed from, e.g., a loudspeaker.

The pitch waveform generating unit 04 will be explained in detail with reference to FIG. 3.

The pitch waveform generating unit 04 can generate an interpolated speaker's pitch waveform 001 based on a maximum of M (M is an integer of 2 or more) speaker's parameters. More specifically, as shown in FIG. 3, the pitch waveform generating unit 04 includes M speaker's parameter storage units 411, . . . , 41M, a speaker's parameter selecting unit 42, a formant mapping unit 43, an interpolated speaker's parameter generating unit 44, NI (concrete value of NI will be described later) sine wave generating units 451, . . . , 45NI, NI multipliers 2001, . . . , 200NI, and an adder 102.

Figure 4:
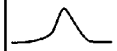
FIG. 4 is a table showing an example of speaker's parameters stored in a speaker's parameter storage unit in FIG. 3.
Figure 4:
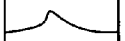
Figure 4:
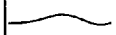

The speaker's parameter storage unit 41*m* (m is an arbitrary integer of 1 (inclusive) to M (inclusive)) stores the speaker's parameters of speaker m after classifying them into respective speech segments. For example, the speaker's parameter storage unit 41*m* stores, in a form as shown in FIG. 4, the speaker's parameter of a speech segment corresponding to a phoneme /a/ for speaker m. In the example of FIG. 4, the speaker's parameter storage unit 41*m* stores 7,231 speech segments corresponding to the phoneme /a/ (this also applies to other phonemes). A speech segment ID is assigned to each speech segment for identification. The first speech segment (ID=1) is formed from 10 frames (in this case, one frame is a time unit corresponding to one pitch waveform 001), and a frame ID is assigned to each frame for identification. A pitch waveform corresponding to the speech of speaker m in the first frame (ID=1) includes eight formants, and a formant ID is assigned to each formant for identification (in the following description, formant IDs are consecutive integers (initial value is "1") assigned to increase in the ascending order of formant frequencies, but the form of the formant ID is not limited to this). As parameters concerning each formant, the formant frequency, formant phase, formant power, and window function are stored in correspondence with the formant ID. In the following description, the formant frequency, formant phase, formant power, and window function of each of formants which form one frame, and the number of formants will be called one formant parameter. Note that the number of speech segments corresponding to each phoneme, that of frames which form each speech segment, and that of formants contained in each frame may be fixed or variable.

Figure 5:
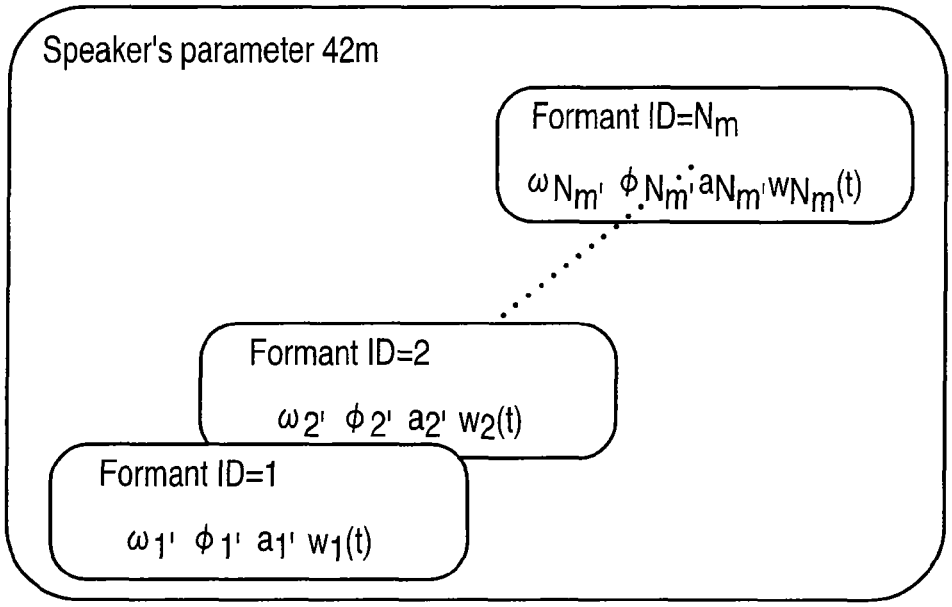
FIG. 5 is a view conceptually showing a speaker's parameter selected by a speaker's parameter selecting unit in FIG. 3.
Figure 6:
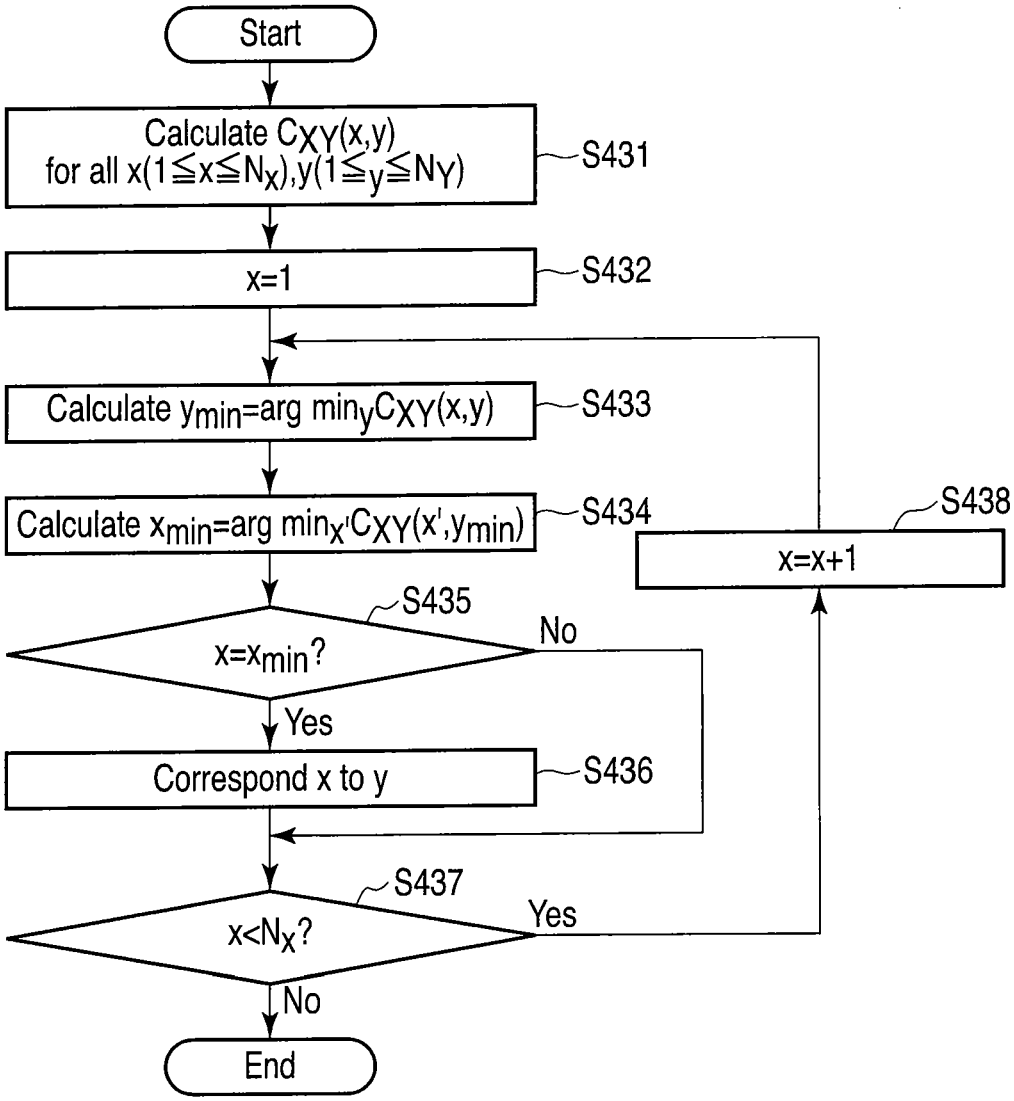
FIG. 6 is a flowchart showing mapping processing performed by a formant mapping unit in FIG. 3.

The speaker's parameter selecting unit 42 selects speaker's parameters 421, . . . , 42M each of one frame based on the pitch pattern 006, phoneme duration 007, and phoneme symbol sequence 008. More specifically, the speaker's parameter selecting unit 42 selects and reads out one of formant parameters stored in the speaker's parameter storage unit 41*m* as the speaker's parameter 42*m* of speaker m. For example, the speaker's parameter selecting unit 42 selects the formant parameter of speaker m as shown in FIG. 5, and reads it out from the speaker's parameter storage unit 41*m*. In the example of FIG. 5, the number of formants contained in the speaker's parameter 42*m* is Nm. As parameters concerning each formant, the speaker's parameter 42*m* contains the formant frequency ω, formant phase ϕ, formant power a, and window function w(t). The speaker's parameter selecting unit 42 inputs the speaker's parameters 421, . . . , 42*m* to the formant mapping unit 43.

The formant mapping unit 43 performs formant mapping (correspondence) between different speakers. More specifically, the formant mapping unit 43 makes each formant contained in the speaker's parameter of a given speaker correspond to one contained in the speaker's parameter of another speaker. The formant mapping unit 43 calculates a cost for making formants correspond to each other by using a cost function (to be described later), and then makes the formants correspond to each other. In the correspondence performed by the formant mapping unit 43, a corresponding formant is not always obtained for all formants (in the first place, the numbers of formants do not coincide with each other between a plurality of speaker's parameters). In the following description, assume that the formant mapping unit 43 succeeds in correspondence of NI formants in respective speaker's parameters. The formant mapping unit 43 notifies the interpolated speaker's parameter generating unit 44 of a mapping result 431, and inputs the speaker's parameters 421, . . . , 42*m* to the interpolated speaker's parameter generating unit 44.

The interpolated speaker's parameter generating unit 44 generates an interpolated speaker's parameter in accordance with a predetermined interpolation ratio and the mapping result 431. Details of the interpolated speaker's parameter generating unit 44 will be described later. The interpolated speaker's parameter includes formant frequencies 4411, . . . , 44NI1, formant phases 4412, . . . , 44NI2, formant powers 4413, . . . , 44N13, and window functions 4414, . . . , 44NI4 concerning NI formants. The interpolated speaker's parameter generating unit 44 inputs the formant frequencies 4411, . . . , 44NI1, formant phases 4412, . . . , 44NI2, and formant powers 4413, . . . , 44N13 to the NI sine wave generating units 451, . . . , 45NI, respectively. The interpolated speaker's parameter generating unit 44 inputs the window functions 4414, . . . , 44NI4 to the NI multipliers 2001, . . . , 200NI, respectively.

The sine wave generating unit 45*n* (n is an arbitrary integer of 1 (inclusive) to NI (inclusive)) generates a sine wave 46*n* in accordance with the formant frequency 44*n*1, formant phase 44*n*2, and formant power 44*n*3 concerning the nth formant. The sine wave generating unit 45*n* inputs the sine wave 46*n* to the multiplier 200*n*. The multiplier 200*n* multiplies the sine wave 46*n* input from the sine wave generating unit 45*n* by the window function 44*n*4, obtaining the nth formant waveform 47*n*. The multiplier 200*n* inputs the formant waveform 47*n* to the adder 102. Letting $\omega_n$ be the value of the formant frequency 44*n*1 concerning the nth formant, $\phi_n$ be the value of the formant phase 44*n*2, $a_n$ be the value of the formant power 44*n*3, $w_n(t)$ be the window function 44*n*4, and $y_n(t)$ be the nth formant waveform 47*n*, equation (1) is established:

$$y_n(t)=w_n(t)\cdot a_n\cdot\cos(\omega_n t+\phi_n) \tag{1}$$

Figure 11:
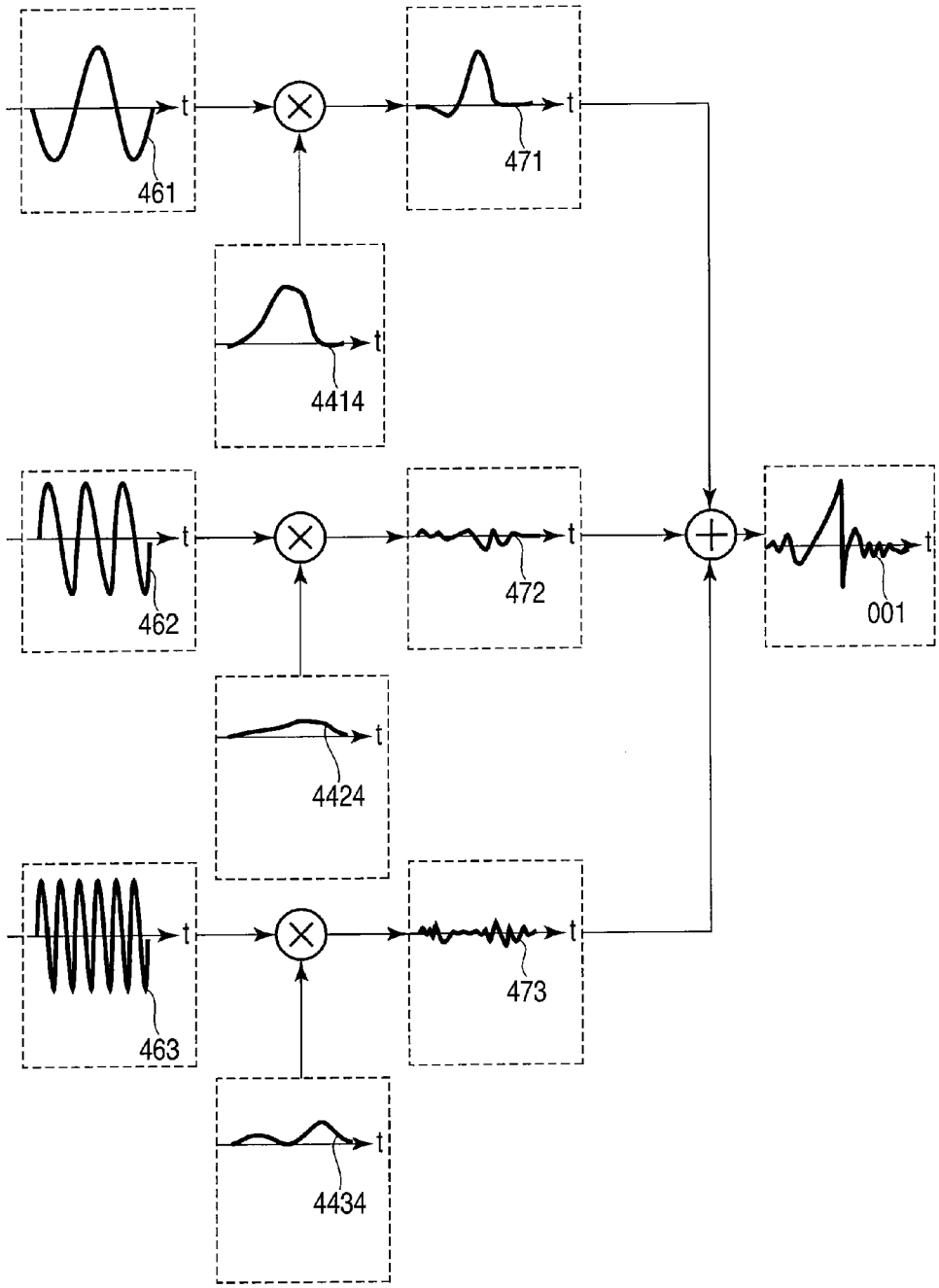
FIG. 11 is a view showing a state in which the pitch waveform generating unit in FIG. 3 generates a pitch waveform corresponding to interpolated speech, based on a sine wave and window function.
Figure 12:
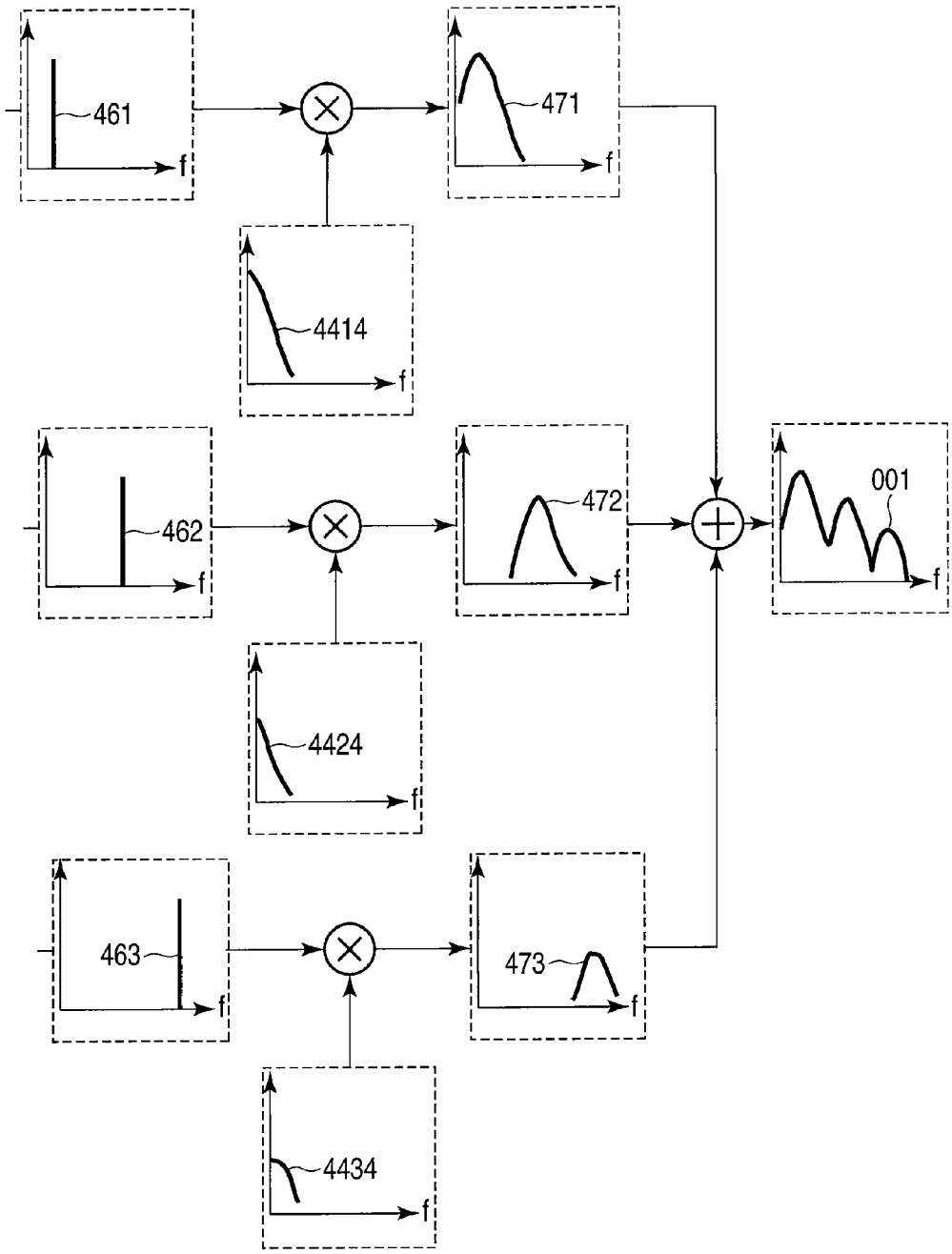
FIG. 12 is a view showing a state in which the pitch waveform generating unit in FIG. 3 generates a pitch waveform corresponding to interpolated speech, based on a sine wave and window function.

The adder 102 adds N formant waveforms 471, . . . , 47NI, generating a pitch waveform 001 corresponding to interpolated speech. For example, for the NI value=3, the adder 102 adds the first formant waveform 471, second formant waveform 472, and third formant waveform 473, generating a pitch waveform 001 corresponding to interpolated speech, as shown in FIGS. 11 and 12. In FIG. 11, graphs in dotted-line regions represent temporal changes (i.e., amplitudes with respect to the time) of sine waves 461, . . . , 463, the window functions 4414, . . . , 4434, the formant waveforms 471, . . . , 473, and the pitch waveform 001. In FIG. 12, graphs in dotted-line regions represent the power spectra (i.e., amplitudes with respect to the frequency) of the graphs in FIG. 11. In this way, the sine wave generating units 451, . . . , 45NI, the multipliers 2001, . . . , 200NI, and the adder 102 operate as a pitch waveform synthesizing unit, thereby generating a pitch waveform 001 corresponding to interpolated speech.

An example of the cost function usable by the formant mapping unit 43 will be explained.

In this case, attention is paid to a difference in formant frequencies and a difference in formant powers as a cost for making formants correspond to each other. Assume that the speaker's parameter selecting unit 42 selects a speaker's parameter 42X of speaker X and a speaker's parameter 42Y of speaker Y. The speaker's parameter 42X contains Nx formants, and the speaker's parameter 42Y contains Ny formants. Note that the Nx and Ny values may be equal to or different from each other. At this time, a cost $C_{xy}(x,y)$ for making the xth (i.e., formant ID=x) formant of speaker X and the yth formant (i.e., formant ID=y) of speaker Y correspond to each other can be calculated by $$C_{XY}(x,y)=w_\omega\cdot(\omega_X{}^x-\omega_Y{}^y)^2+w_a\cdot(\log a_X{}^x-\log a_Y{}^y)^2 \tag{2}$$

where $\omega_X{}^x$ is the formant frequency of the xth formant contained in the speaker's parameter 42X, $\omega_Y{}^y$ is the formant frequency of the yth formant contained in the speaker's parameter 42Y, $a_X{}^x$ is the formant power of the xth formant contained in the speaker's parameter 42X, and $a_Y{}^y$ is the formant power of the yth formant contained in the speaker's parameter 42Y. In equation (2), $w_\omega$ is the weight of the formant frequency, and $w_a$ is that of the formant power. For $w_\omega$ and $w_a$, it suffices to arbitrarily set values derived from the design/experiment. The cost function of equation (2) is the weighted sum of the square of the formant frequency difference and that of the formant power difference. However, the cost function of the formant mapping unit 43 is not limited to this. For example, the cost function may be the weighted sum of the absolute value of the formant frequency difference and that of the formant power difference, or a proper combination of other functions effective for evaluating the correspondence between formants. In the following description, the cost function is equation (2), unless otherwise specified.

Mapping processing performed by the formant mapping unit 43 will be explained with reference to FIGS. 6, 7, 8, and 9. Assume that the formant mapping unit 43 makes the speaker's parameter 42X of speaker X and the speaker's parameter 42Y of speaker Y correspond to each other. The speaker's parameter 42X contains Nx formants, and the speaker's parameter 42Y contains Ny formants. The formant mapping unit 43 holds, for example, the mapping result 431 as shown in FIG. 7, and updates it during mapping processing. In the mapping result 431 shown in FIG. 7, the formant IDs of the formants of the speaker's parameter 42Y that correspond to the respective formants of the speaker's parameter 42X are stored in cells (fields) belonging to the column of speaker X. Also, the formant IDs of the formants of the speaker's parameter 42X that correspond to the respective formants of the speaker's parameter 42Y are stored in cells belonging to the column of speaker Y. When there is no corresponding formant ID, "−1" is stored.

At the start of mapping processing, no formant corresponds to another, so the mapping result 431 is one as shown in FIG. 7. After mapping processing starts, the formant mapping unit 43 calculates the cost in a round-robin fashion between all formants contained in the speaker's parameter 42X and those contained in the speaker's parameter 42Y (step S431). In this example, the formant mapping unit 43 calculates the costs of 36 pairs (=9×8/2). The formant mapping unit 43 substitutes "1" into a variable x for designating the formant ID of the speaker's parameter 42X (step S432). Then, the process advances to step S433.

In step S433, for a formant having the formant ID=x in the speaker's parameter 42X, the formant mapping unit 43 derives the formant ID=$y_{min}$ for the formant of the speaker's parameter 42Y that minimizes the cost. More specifically, the formant mapping unit 43 calculates $$y_{min}=\arg\min_y C_{XY}(x,y) \tag{3}$$

For the formant having the formant ID=$y_{min}$ in the speaker's parameter 42Y, the formant mapping unit 43 derives the formant ID=$x_{min}$ for the formant of the speaker's parameter 42X that minimizes the cost (step S434). More specifically, the formant mapping unit 43 calculates $$x_{min}=\arg\min_x C_{XY}(x',y_{min}) \tag{4}$$

Next, the formant mapping unit 43 determines whether $x_{min}$ derived in step S434 coincides with the current value of the variable x (step S435). If the formant mapping unit 43 determines that $X_{min}$ coincides with x, the process advances to S436; otherwise, to step S437.

In step S436, the formant mapping unit 43 makes the formant having the formant ID=x (=$X_{min}$) in the speaker's parameter 42X correspond to that having the formant ID=$y_{min}$ in the speaker's parameter 42Y. After that, the process advances to step S437. That is, the formant mapping unit 43 stores $y_{min}$ in a cell designated by (row, column)=(x, speaker X), and x in a cell designated by (row, column)=($y_{min}$, speaker Y) in the mapping result 431.

In step S437, the formant mapping unit 43 determines whether the current value of the variable x is smaller than $N_x$. If the formant mapping unit 43 determines that the variable x is smaller than $N_x$, the process advances to step S438; otherwise, ends. In step S438, the formant mapping unit 43 increments the variable x by "1", and the process returns to step S433.

At the end of mapping processing by the formant mapping unit 43, the mapping result 431 is as shown in FIG. 8. In the mapping result 431 shown in FIG. 8, the formant ID=1 in the speaker's parameter 42X and the formant ID=1 in the speaker's parameter 42Y correspond to each other, the formant ID=2 in the speaker's parameter 42X and the formant ID=2 in the speaker's parameter 42Y correspond to each other, the formant ID=4 in the speaker's parameter 42X and the formant ID=3 in the speaker's parameter 42Y correspond to each other, the formant ID=5 in the speaker's parameter 42X and the formant ID=4 in the speaker's parameter 42Y correspond to each other, the formant ID=7 in the speaker's parameter 42X and the formant ID=5 in the speaker's parameter 42Y correspond to each other, the formant ID=8 in the speaker's parameter 42X and the formant ID=6 in the speaker's parameter 42Y correspond to each other, and the formant ID=9 in the speaker's parameter 42X and the formant ID=7 in the speaker's parameter 42Y correspond to each other. In the mapping result 431 shown in FIG. 8, formants identified by the formant ID=3 and 8 of the speaker's parameter 42X and the formant ID=8 of the speaker's parameter 42Y do not correspond to others.

Figure 9:
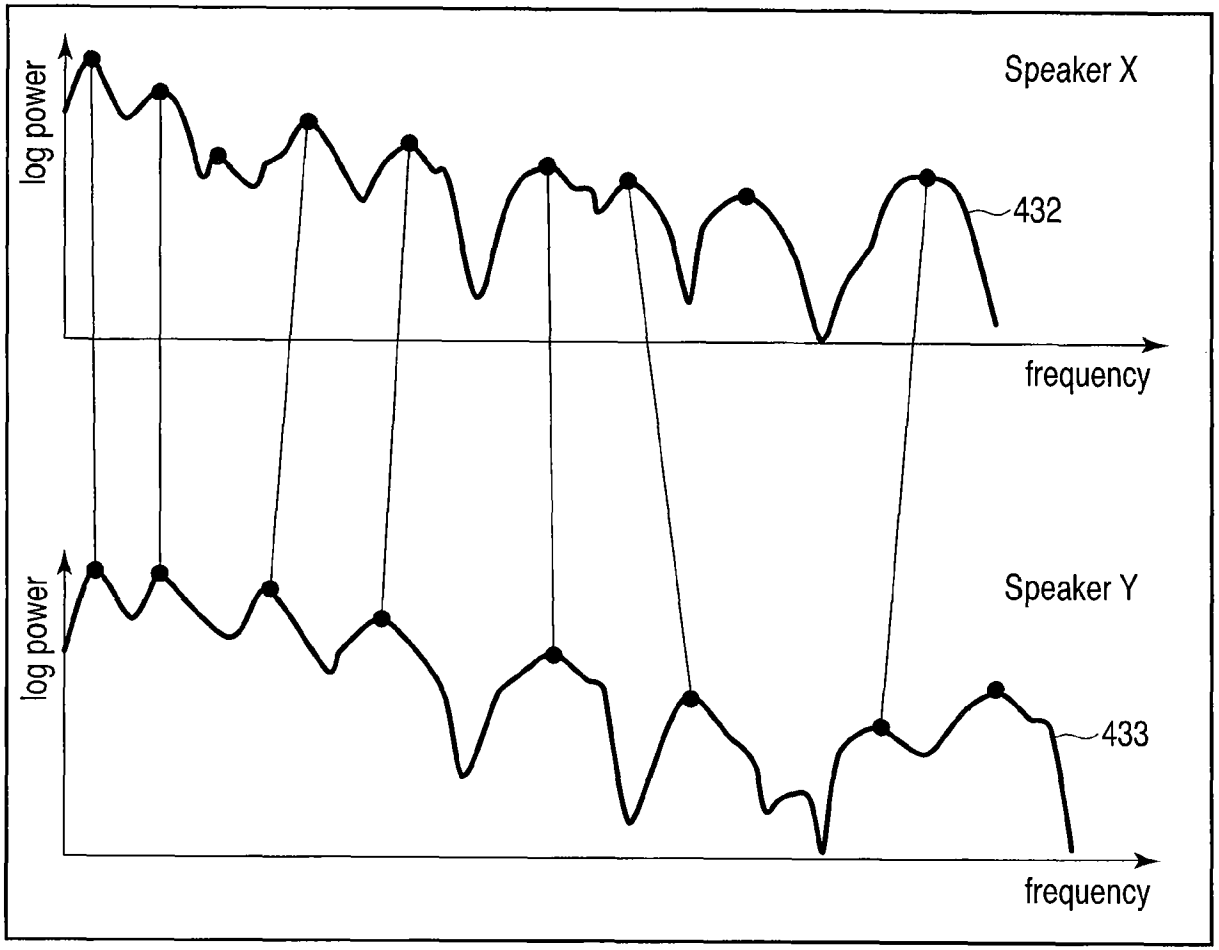
FIG. 9 is a view showing the formant correspondence between speakers X and Y based on the mapping result in FIG. 8.

FIG. 9 shows log power spectra 432 and 433 having pitch waveforms obtained by applying the method described in Japanese Patent Publication No. 3732793 to the speaker's parameters 42X and 42Y. In the log power spectra 432 and 433, black dots indicate formants. Lines which connect respective formants contained in the log power spectrum 432 and those contained in the log power spectrum 433 represent a formant correspondence based on the mapping result 431 shown in FIG. 8.

Even for three or more speakers' parameters, the formant mapping unit 43 can perform mapping processing. For example, a speaker's parameter 42Z of speaker Z can also undergo mapping processing, in addition to the speaker's parameters 42X and 42Y. More specifically, the formant mapping unit 43 performs mapping processing between the speaker's parameters 42X and 42Y, between the speaker's parameters 42X and 42Z, and between the speaker's parameters 42Y and 42Z. If the formant ID=x in the speaker's parameter 42X corresponds to the formant ID=y in the speaker's parameter 42Y, the formant ID=x in the speaker's parameter 42X corresponds to the formant ID=z in the speaker's parameter 42Z, and the formant ID=y in the speaker's parameter 42Y corresponds to the formant ID=z in the speaker's parameter 42Z, the formant mapping unit 43 makes these three formants correspond to each other. Also, when four or more speakers' parameters are subjected to mapping processing, it suffices if the formant mapping unit 43 similarly expands mapping processing and applies it.

Generation processing performed by the interpolated speaker's parameter generating unit 44 will be described with reference to FIG. 10.

The interpolated speaker's parameter generating unit 44 generates an interpolated speaker's parameter by interpolating, at predetermined interpolation ratios, formant frequencies, formant phases, formant powers, and window functions contained in the speaker's parameters 421, . . . , 42M. In the following description, assume that the interpolated speaker's parameter generating unit 44 interpolates the speaker's parameter 42X of speaker X and the speaker's parameter 42Y of speaker Y using interpolation ratios $s_X$ and $s_Y$, respectively. Note that the interpolation ratios $s_X$ and $s_Y$ satisfy $$s_X+s_Y=1 \tag{5}$$

After generation processing starts, the interpolated speaker's parameter generating unit 44 substitutes "1" into a variable x for designating the formant ID of the speaker's parameter 42X, and substitutes "0" into a variable NI for counting formants contained in the interpolated speaker's parameter (step S441). Then, the process advances to step S442.

In step S442, the interpolated speaker's parameter generating unit 44 determines whether the mapping result 431 contains the formant ID of the speaker's parameter 42Y that corresponds to the formant ID=x in the speaker's parameter 42X. Note that $map_{XY}(x)$ shown in FIG. 10 is a function of returning the formant ID of the speaker's parameter 42Y that corresponds to the formant ID=x in the speaker's parameter 42X in the mapping result 431. If $map_{XY}(x)$ is "−1", the process advances to step S448; otherwise, to step S443.

In step S443, the interpolated speaker's parameter generating unit 44 increments the variable NI by "1". The interpolated speaker's parameter generating unit 44 then calculates a formant frequency $\omega_I^{NI}$ corresponding to the formant ID (to be referred to as an interpolated formant ID for descriptive convenience)=NI in the interpolated speaker's parameter (step S444). More specifically, the interpolated speaker's parameter generating unit 44 calculates $$\omega_I^{NI}=s_X\cdot\omega_X^x+s_Y\cdot\omega_Y^{mapXY(x)} \tag{6}$$

where $\omega_X^x$ is a formant frequency corresponding to the formant ID=x in the speaker's parameter 42X, and $\omega_Y^{mapXY(x)}$ is a formant frequency corresponding to the formant ID=$map_{XY}$(x) in the speaker's parameter 42Y.

The interpolated speaker's parameter generating unit 44 calculates a formant phase $\phi_I^{NI}$ corresponding to the interpolated formant ID=NI in the interpolated speaker's parameter (step S445). More specifically, the interpolated speaker's parameter generating unit 44 calculates $$\phi_I^{NI}=s_X\cdot\phi_X^x+s_Y\cdot\phi_Y^{mapXY(x)} \tag{7}$$

where $\phi_X^x$ is a formant phase corresponding to the formant ID=x in the speaker's parameter 42X, and $\phi_Y^{mapXY(x)}$ is a formant phase corresponding to the formant ID=$map_{XY}$(x) in the speaker's parameter 42Y.

Then, the interpolated speaker's parameter generating unit 44 calculates a formant power $a_I^{NI}$ corresponding to the interpolated formant ID=NI in the interpolated speaker's parameter (step S446). More specifically, the interpolated speaker's parameter generating unit 44 calculates $$a_I^{NI}=s_X\cdot a_X^x+s_Y\cdot a_Y^{mapXY(x)} \tag{8}$$

where $a_X^x$ is a formant power corresponding to the formant ID=x in the speaker's parameter 42X, and $a_Y^{mapXY(x)}$ is a formant power corresponding to the formant ID=$map_{XY}$(x) in the speaker's parameter 42Y.

The interpolated speaker's parameter generating unit 44 calculates a window function $w_I^{NI}(t)$ corresponding to the interpolated formant ID=NI in the interpolated speaker's parameter (step S447), and the process advances to step S448. More specifically, the interpolated speaker's parameter generating unit 44 calculates $$w_I^{NI}=s_X\cdot w_X^x(t)+s_Y\cdot w_Y^{mapXY(x)}(t) \tag{9}$$

where $w_X^x(t)$ is a window function corresponding to the formant ID=x in the speaker's parameter 42X, and $w_Y^{mapXY(x)}(t)$ is a window function corresponding to the formant ID=$map_{XY}$(x) in the speaker's parameter 42Y.

In step S448, the interpolated speaker's parameter generating unit 44 determines whether x is smaller than $N_x$. If x is smaller than $N_x$, the process advances to step S449; otherwise, ends. In step S449, the interpolated speaker's parameter generating unit 44 increments the variable x by "1", and the process returns to step S442. Note that at the end of generation processing by the interpolated speaker's parameter generating unit 44, the value of the variable NI coincides with the number of formants which correspond to each other between the speaker's parameters 42X and 42Y in the mapping result 431.

Figure 10:
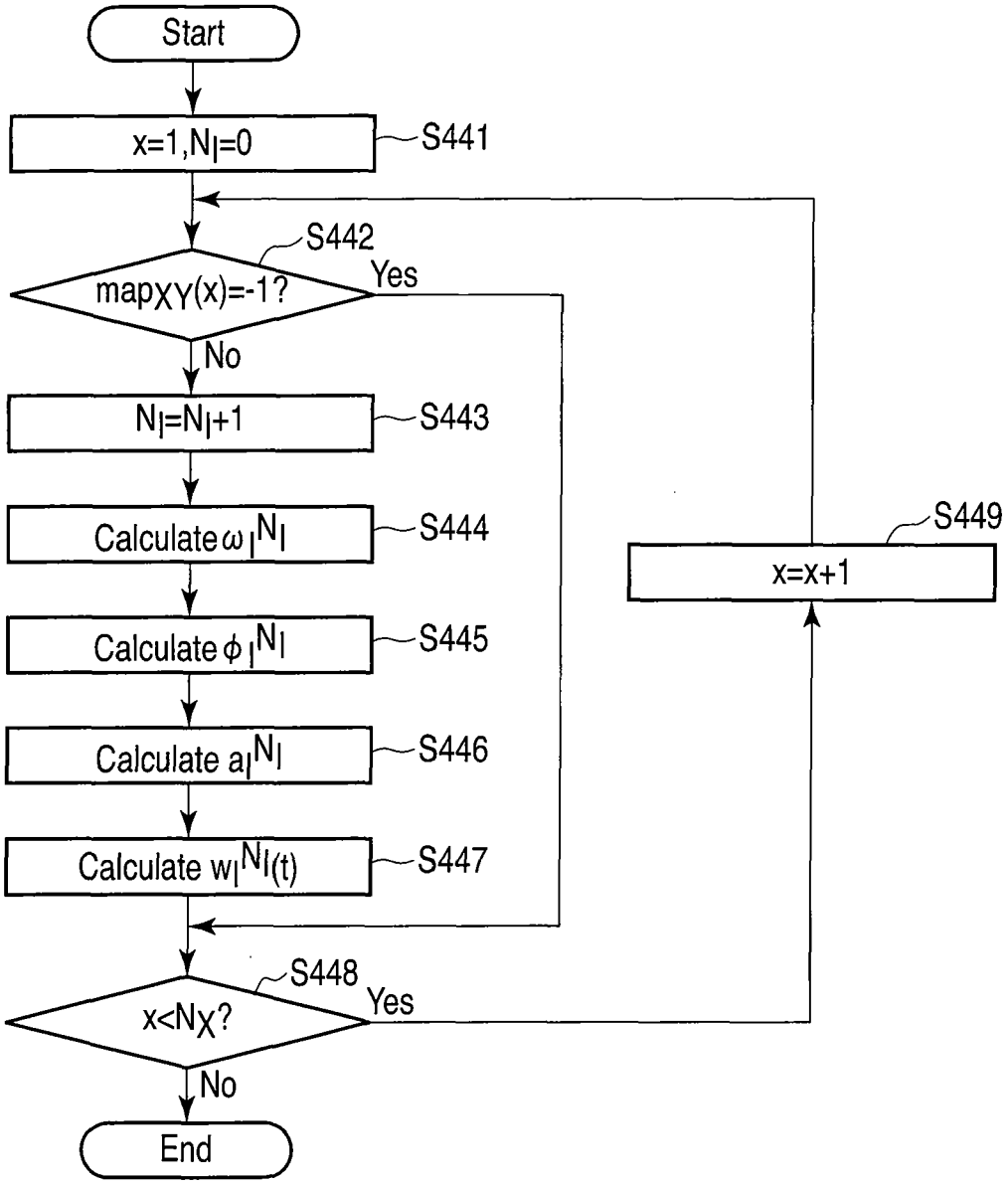
FIG. 10 is a flowchart showing generation processing performed by an interpolated parameter generating unit in FIG. 3.

The generation processing shown in FIG. 10 can also be expanded and applied to three or more speakers' parameters. More specifically, in steps S444 to S447, it suffices if the interpolated speaker's parameter generating unit 44 calculates $$\omega_I^n=\Sigma_{m=1}^M s_m\omega_m^{map1m(x)}$$

$$\phi_I^n=\Sigma_{m=1}^M s_m\phi_m^{map1m(x)}$$

$$a_I^n=\Sigma_{m=1}^M s_m a_m^{map1m(x)}$$

$$w_I^n(t)=\Sigma_{m=1}^M s_m w_m^{map1m(x)}(t) \tag{10}$$

where $s_m$ is an interpolation ratio assigned to the speaker's parameter 42*m*, and $\omega_I^n$, $\phi_I^n$, $a_I^n$, $w_I^n(t)$ are a formant frequency, formant phase, formant power, and window function corresponding to the formant ID=n (n is an arbitrary integer of 1 (inclusive) to NI (inclusive)) in the interpolated speaker's parameter. Assume that the interpolation ratio $s_m$ satisfies $$\Sigma_{m=1}^M s_m=1 \tag{11}$$

As described above, the speech synthesis apparatus according to the first embodiment makes formants correspond to each other between a plurality of speaker's parameters, and generates an interpolated speaker's parameter in accordance with the correspondence between the formants. The speech synthesis apparatus according to the first embodiment can synthesize interpolated speech with a desired voice quality even when the positions and number of formants differ between a plurality of speakers' parameters.

Differences of the speech synthesis apparatus according to the first embodiment from the foregoing Japanese Patent Publication No. 3732793 and Japanese Patent Publication No. 2951514 will be described briefly. The speech synthesis apparatus according to the first embodiment is different from the speech synthesis method described in Japanese Patent Publication No. 3732793 in that it generates a pitch waveform using an interpolated speaker's parameter based on a plurality of speaker's parameters. That is, the speech synthesis apparatus according to the first embodiment can achieve a wide variety of voice quality control operations because many speakers' parameters can be used, unlike the speech synthesis method described in Japanese Patent Publication No. 3732793. The speech synthesis apparatus according to the first embodiment is different from the speech synthesis apparatus described in Japanese Patent Publication No. 2951514 in that it makes formants correspond to each other between a plurality of speakers' parameters, and performs interpolation based on the correspondence. That is, the speech synthesis apparatus according to the first embodiment can stably obtain high-quality interpolated speech even by using a plurality of speakers' parameters differing in the positions and number of formants.

Second Embodiment

In the speech synthesis apparatus according to the first embodiment, the interpolated speaker's parameter generating unit 44 generates an interpolated speaker's parameter using formants which have succeeded in correspondence by the formant mapping unit 43. To the contrary, an interpolated speaker's parameter generating unit 44 in a speech synthesis apparatus according to the second embodiment uses even a formant which has failed in correspondence by a formant mapping unit 43 (i.e., which does not correspond to any formant of another speaker's parameter) by inserting it into the interpolated speaker's parameter.

Figure 13:
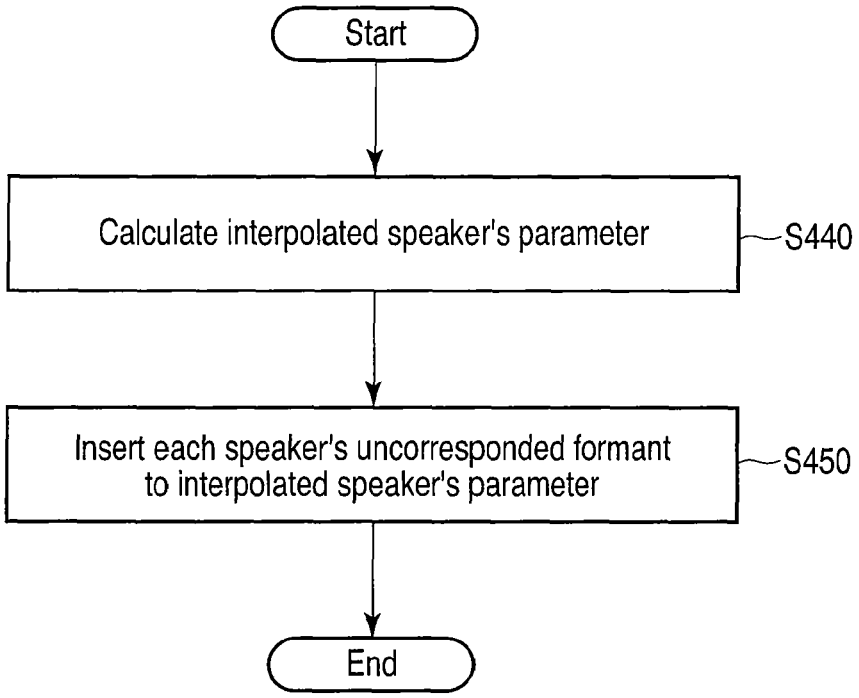
FIG. 13 is a flowchart showing generation processing performed by the interpolated speaker's parameter generating unit of a speech synthesis apparatus according to the second embodiment.

FIG. 13 shows interpolated speaker's parameter generation processing by the interpolated speaker's parameter generating unit 44. First, the interpolated speaker's parameter generating unit 44 generates (calculates) an interpolated speaker's parameter (step S440). Note that the interpolated speaker's parameter in step S440 is generated from formants which have been made to correspond to others by the formant mapping unit 43, similar to the first embodiment described above. Then, the interpolated speaker's parameter generating unit 44 inserts an uncorresponded formant of each speaker's parameter to the interpolated speaker's parameter generated in step S440 (step S450).

Figure 14:
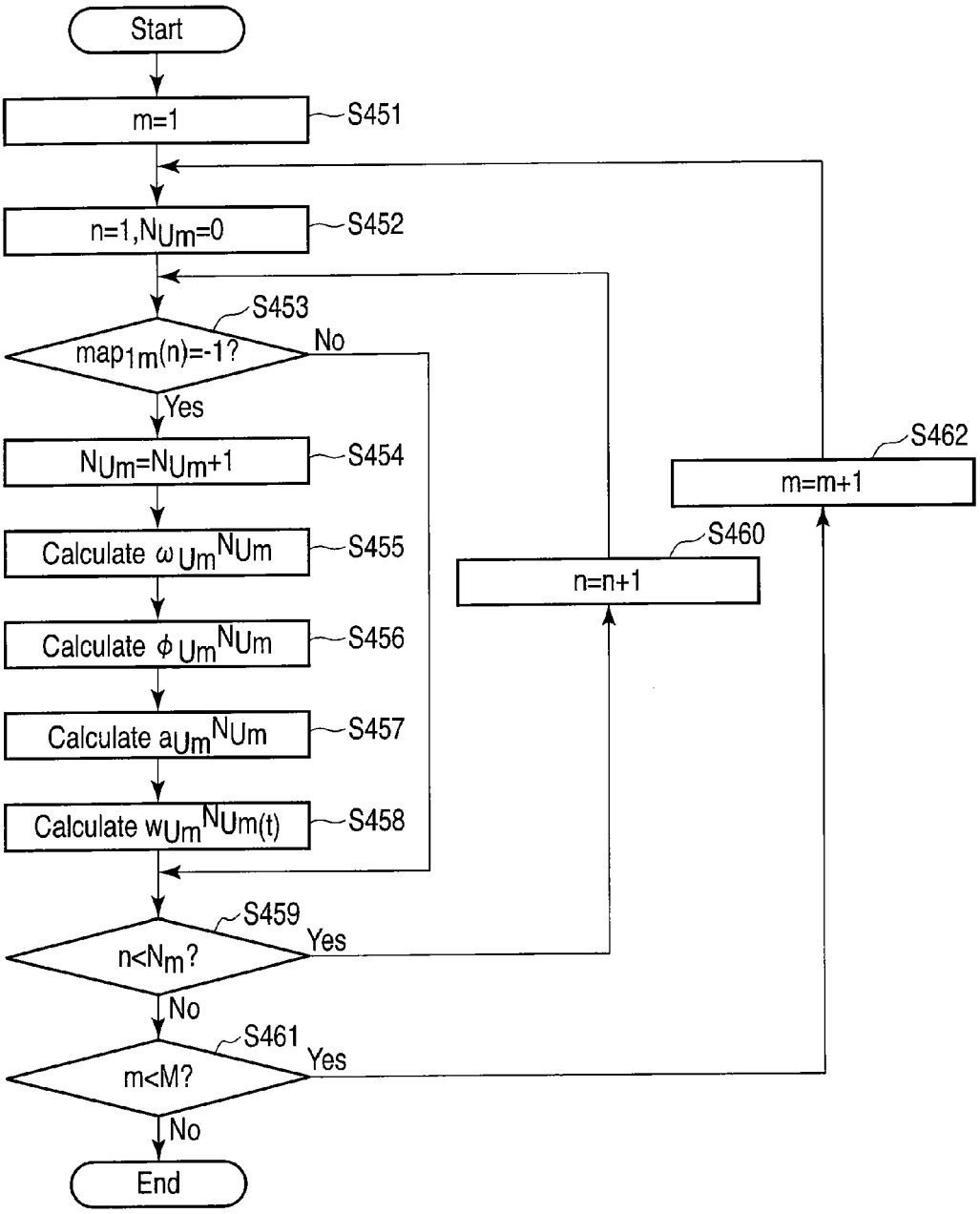
FIG. 14 is a flowchart showing details of insertion processing performed in step S450 of FIG. 13.

Processing performed by the interpolated speaker's parameter generating unit 44 in step S450 will be explained with reference to FIG. 14.

After the processing in step S450 starts, the interpolated speaker's parameter generating unit 44 substitutes "1" into a variable m, and the process advances to step S452 (step S451). The variable m is one for designating a speaker ID for identifying a target speaker's parameter. In the following description, the speaker ID is an integer of 1 (inclusive) to M (inclusive) which is assigned to each of speaker's parameter storage units 411, . . . , 41M and differs between them. However, the speaker ID is not limited to this.

In step S452, the interpolated speaker's parameter generating unit 44 substitutes "1" into a variable n and "0" into a variable $N_{Um}$, and the process advances to step S453. The variable n is one for designating a formant ID for identifying a formant in the speaker's parameter having the speaker ID=m. The variable $N_{Um}$ is one for counting formants in the speaker's parameter having the speaker ID=m that have been inserted by the insertion processing shown in FIG. 14.

In step S453, the interpolated speaker's parameter generating unit 44 refers to a mapping result 431 to determine whether the formant corresponding to the formant ID=n in the speaker's parameter having the speaker ID=m corresponds to any formant in the speaker's parameter having the speaker ID=1. More specifically, the interpolated speaker's parameter generating unit 44 determines whether the value returned from a function $map_{1m}(n)$ is "−1". If the value returned from the function $map_{1m}(n)$ is "−1", the process advances to step S454; otherwise, to step S459.

In step S454, the interpolated speaker's parameter generating unit 44 increments the variable $N_{Um}$ by "1". Then, the interpolated speaker's parameter generating unit 44 calculates a formant frequency $\omega_{Um}^{N_{Um}}$ corresponding to the formant ID (to be referred to as an inserted formant ID for descriptive convenience)=$N_{Um}$ (step S455). More specifically, the interpolated speaker's parameter generating unit 44 calculates $$\omega_{Um}^{NU_m} = \omega_I^k\left(\omega_I^{(k+1)} - \omega_I^k\right)\cdot\frac{\omega_m^n - \omega_m^{(n-1)}}{\omega_m^{(n+1)} - \omega_m^{(n-1)}} \tag{12}$$

Figure 15:
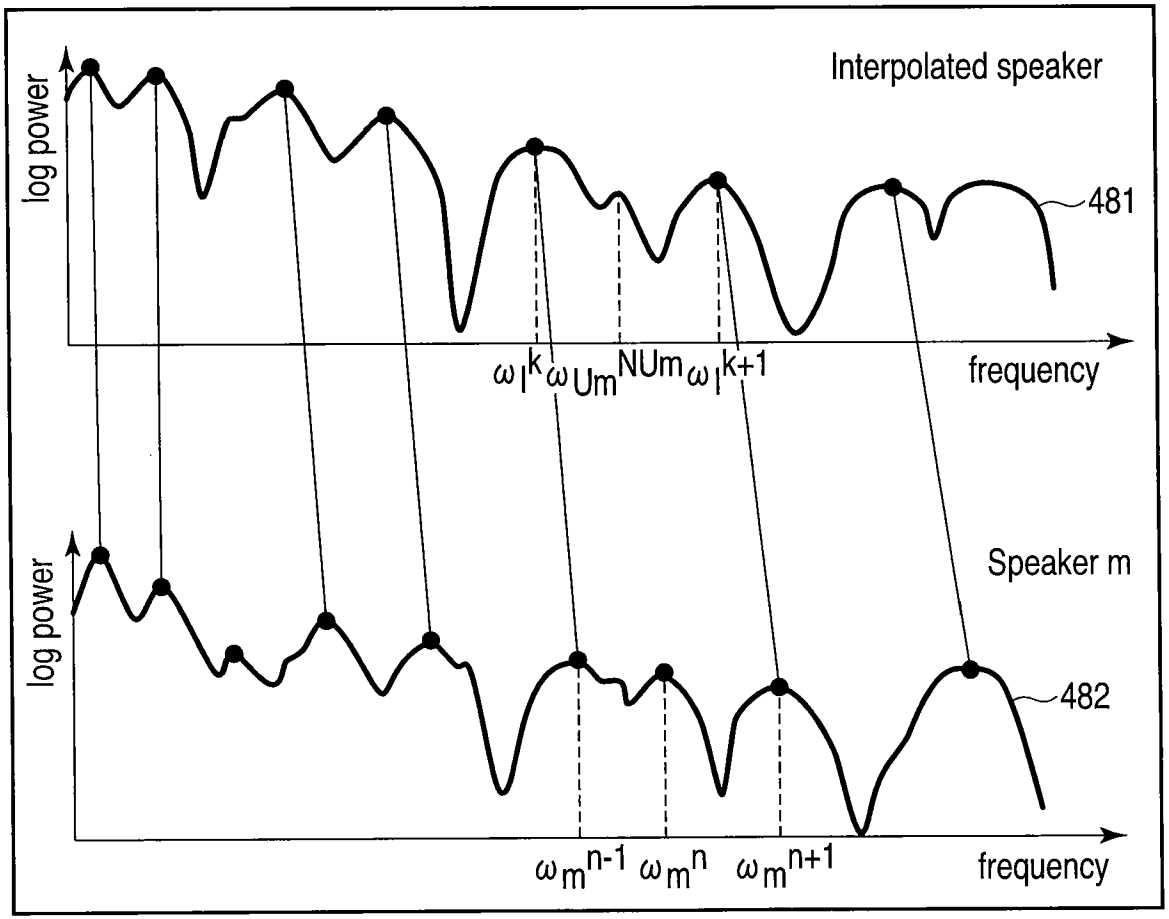
FIG. 15 is a view showing an example of insertion of formants based on the processing of FIG. 14.

As a precondition for applying equation (12), it is necessary for a formant having the formant ID=(n−1) in the speaker's parameter having the speaker ID=m to be used to generate a formant having the interpolated formant ID=k in the interpolated speaker's parameter, and a formant having the formant ID=(n+1) in the speaker's parameter having the speaker ID=m to be used to generate a formant having the interpolated formant ID=(k+1) in the interpolated speaker's parameter. By applying equation (12), the formant frequency $\omega_{Um}^{N_{Um}}$ in a log spectrum 481 of the pitch waveform of the interpolated speaker is derived so that it corresponds to a formant frequency $\omega_m^n$ in a log spectrum 482 of the pitch waveform of speaker m, as shown in FIG. 15. However, even if this precondition is not met, those skilled in the art can derive an appropriate formant frequency $\omega_{Um}^{N_{Um}}$ by properly correcting and applying equation (12).

Thereafter, the interpolated speaker's parameter generating unit 44 calculates a formant phase $\phi_{Um}^{N_{Um}}$ corresponding to the inserted formant ID=$N_{Um}$ (step S456). More specifically, the interpolated speaker's parameter generating unit 44 calculates $$\phi_{Um}=s_m\cdot\phi_m^n \tag{13}$$

The interpolated speaker's parameter generating unit 44 then calculates a formant power $a_{Um}^{N_{Um}}$ corresponding to the inserted formant ID=$N_{Um}$ (step S457). More specifically, the interpolated speaker's parameter generating unit 44 calculates $$a_{Um}=s_m\cdot a_m^n \tag{14}$$

The interpolated speaker's parameter generating unit 44 calculates a window function $w_{Um}(t)$ corresponding to the inserted formant ID=$N_{Um}$ (step S458), and the process advances to step S459. More specifically, the interpolated speaker's parameter generating unit 44 calculates $$w_{Um}(t)=s_m\cdot w_m^n(t) \tag{15}$$

In step S459, the interpolated speaker's parameter generating unit 44 determines whether the value of the variable n is smaller than $N_m$. If the value of the variable n is smaller than $N_m$, the process advances to step S460; otherwise, to step S461. Note that at the end of insertion processing for speaker m, the variable $N_{Um}$ satisfies $$N_m=N_I+N_{Um} \tag{16}$$

In step S460, the interpolated speaker's parameter generating unit 44 increments the variable n by "1", and the process returns to step S453. In step S461, the interpolated speaker's parameter generating unit 44 determines whether the variable m is smaller than M. If m is smaller than M, the process advances to step S462; otherwise, ends. In step S462, the interpolated speaker's parameter generating unit 44 increments the variable m by "1", and the process returns to step S452.

As described above, the speech synthesis apparatus according to the second embodiment inserts, into an interpolated speaker's parameter, a formant uncorresponded by the formant mapping unit. Since the speech synthesis apparatus according to the second embodiment can use a larger number of formants to synthesize interpolated speech, discontinuity hardly occurs in the spectrum of interpolated speech, i.e., the quality of interpolated speech can be improved.

Third Embodiment

Figure 16:
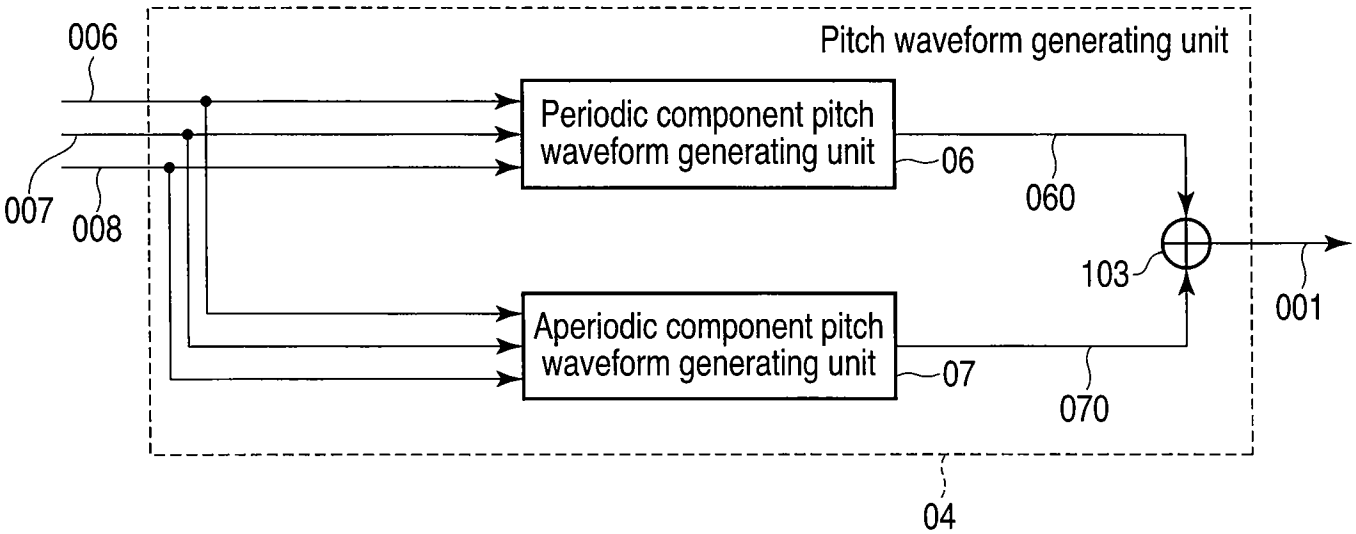
FIG. 16 is a block diagram showing the pitch waveform generating unit of a speech synthesis apparatus according to the third embodiment.

A speech synthesis apparatus according to the third embodiment can be implemented by changing the arrangement of the pitch waveform generating unit 04 in the speech synthesis apparatus according to the first or second embodiment. As shown in FIG. 16, a pitch waveform generating unit 04 in the speech synthesis apparatus according to the third embodiment includes a periodic component pitch waveform generating unit 06, aperiodic component pitch waveform generating unit 07, and adder 103.

The periodic component pitch waveform generating unit 06 generates a periodic component pitch waveform 060 of interpolated speaker's speech based on a pitch pattern 006, phoneme duration 007, and phoneme symbol sequence 008, and inputs it to the adder 103. The aperiodic component pitch waveform generating unit 07 generates an aperiodic component pitch waveform 070 of interpolated speaker's speech based on the pitch pattern 006, phoneme duration 007, and phoneme symbol sequence 008, and inputs it to the adder 103. The adder 103 adds the periodic component pitch waveform 060 and aperiodic component pitch waveform 070, generates a pitch waveform 001 and inputs it to a waveform superposing unit 05.

Figure 3:
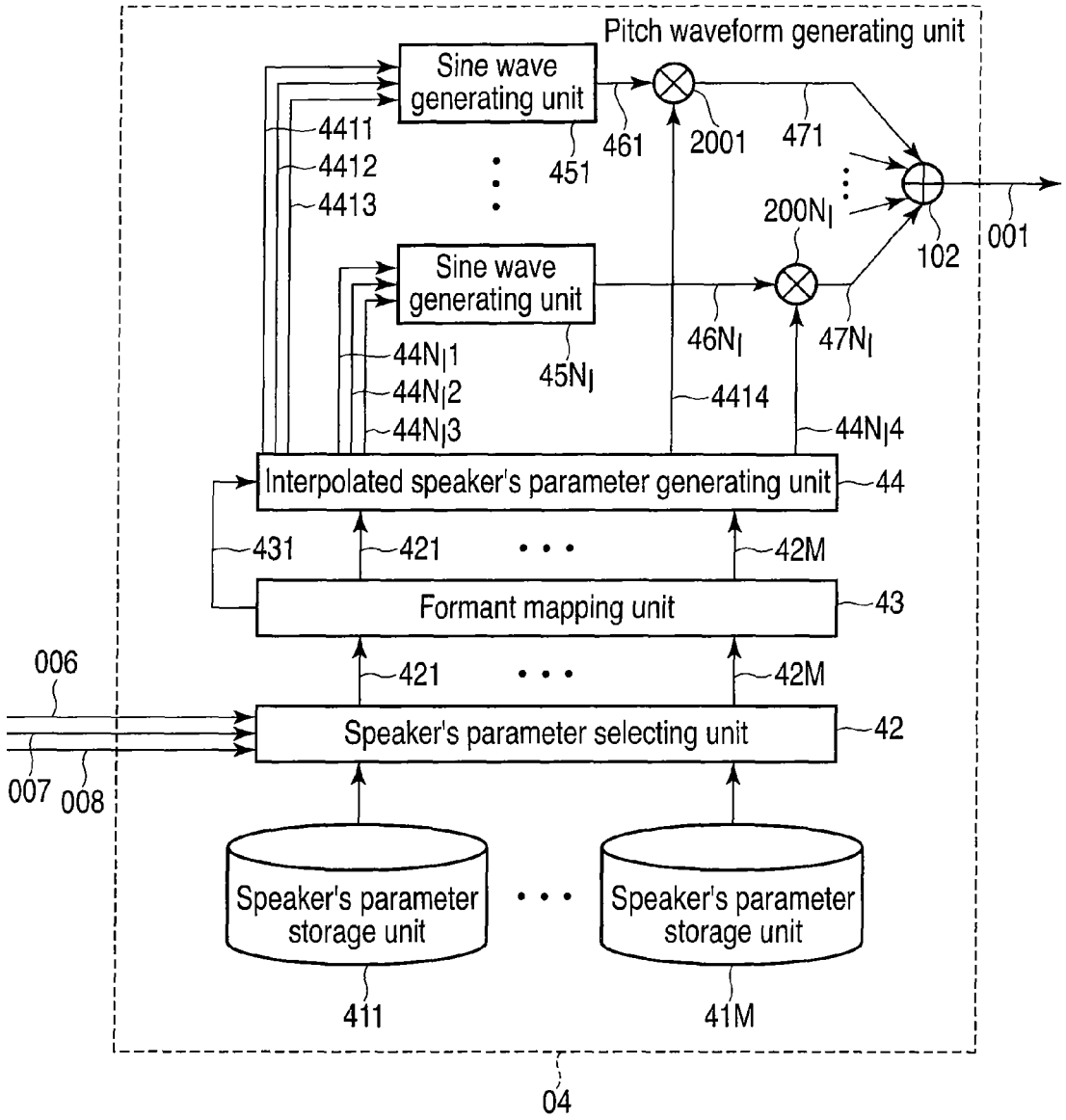
FIG. 3 is a block diagram showing the internal arrangement of a pitch waveform generating unit in FIG. 1.
Figure 17:
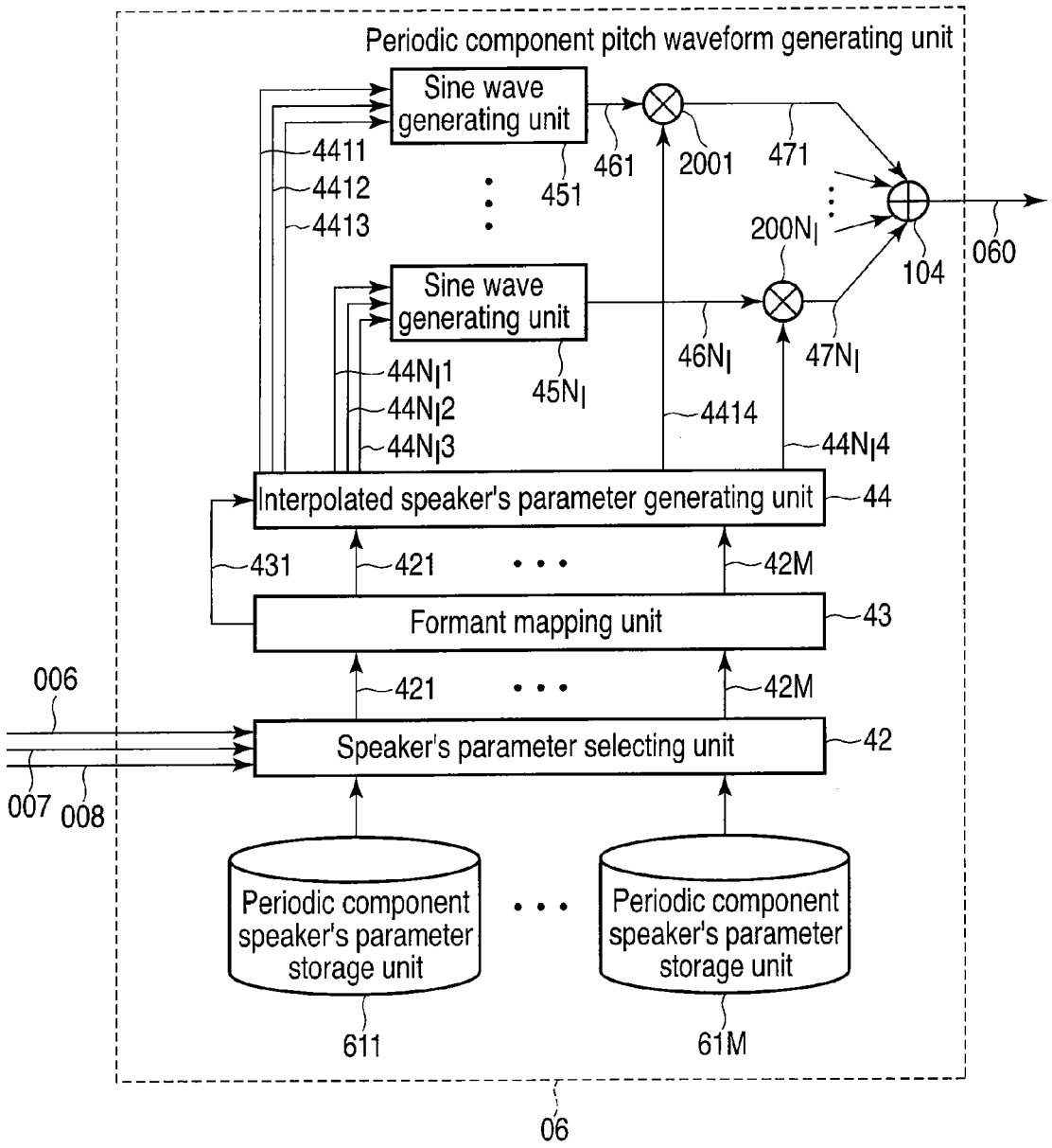
FIG. 17 is a block diagram showing the internal arrangement of a periodic component pitch waveform generating unit in FIG. 16.

As shown in FIG. 17, the periodic component pitch waveform generating unit 06 is implemented by replacing the speaker's parameter storage units 411, . . . , 41M in the pitch waveform generating unit 04 shown in FIG. 3 with periodic component speaker's parameter storage units 611, . . . , 61M.

The periodic component speaker's parameter storage units 611, . . . , 61M store, as periodic component speaker's parameters, formant frequencies, formant phases, formant powers, window functions, and the like concerning not pitch waveforms corresponding to respective speaker's speech sounds but pitch waveforms corresponding to the periodic components of respective speaker's speech sounds. As a method for dividing speech into periodic and aperiodic components, one described in reference "P. Jackson, 'Pitch-Scaled Estimation of Simultaneous Voiced and Turbulence-Noise Components in Speech', IEEE Trans. Speech and Audio Processing, vol. 9, pp. 713-726, October 2001" is applicable. However, the method is not limited to this.

Figure 18:
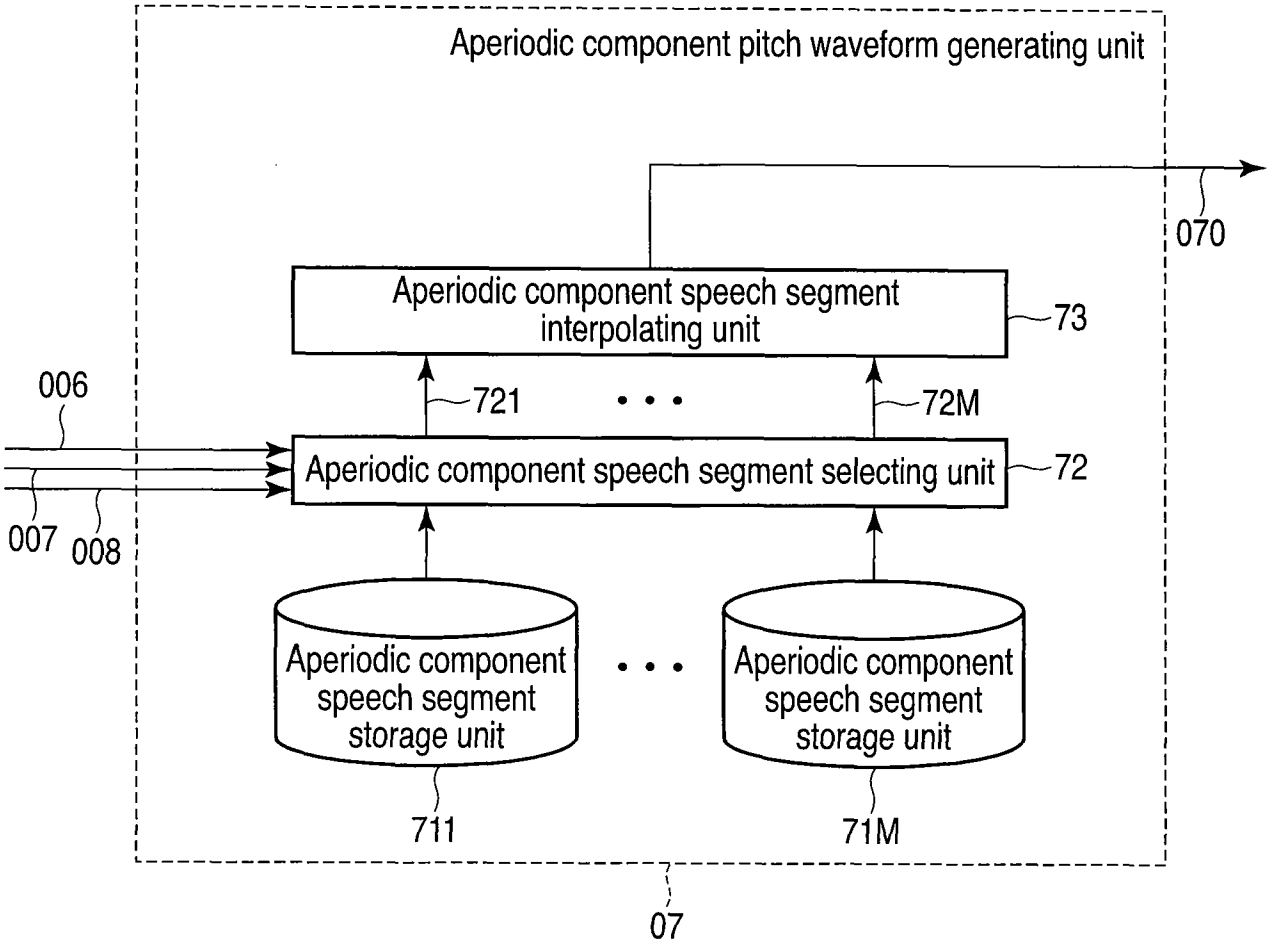
FIG. 18 is a block diagram showing the internal arrangement of an aperiodic component pitch waveform generating unit in FIG. 16.

As shown in FIG. 18, the aperiodic component pitch waveform generating unit 07 includes aperiodic component speech segment storage units 711, . . . , 71M, an aperiodic component speech segment selecting unit 72, and an aperiodic component speech segment interpolating unit 73.

The aperiodic component speech segment storage units 711, . . . , 71M store pitch waveforms (aperiodic component pitch waveforms) corresponding to the aperiodic components of respective speaker's speech sounds.

Based on the pitch pattern 006, phoneme duration 007, and phoneme symbol sequence 008, the aperiodic component speech segment selecting unit 72 selects and reads out aperiodic component pitch waveforms 721, . . . , 72M each of one frame from aperiodic component pitch waveforms stored in the aperiodic component speech segment storage units 711, . . . , 71M. The aperiodic component speech segment selecting unit 72 inputs the aperiodic component pitch waveforms 721, . . . , 72M to the aperiodic component speech segment interpolating unit 73.

Figure 19:
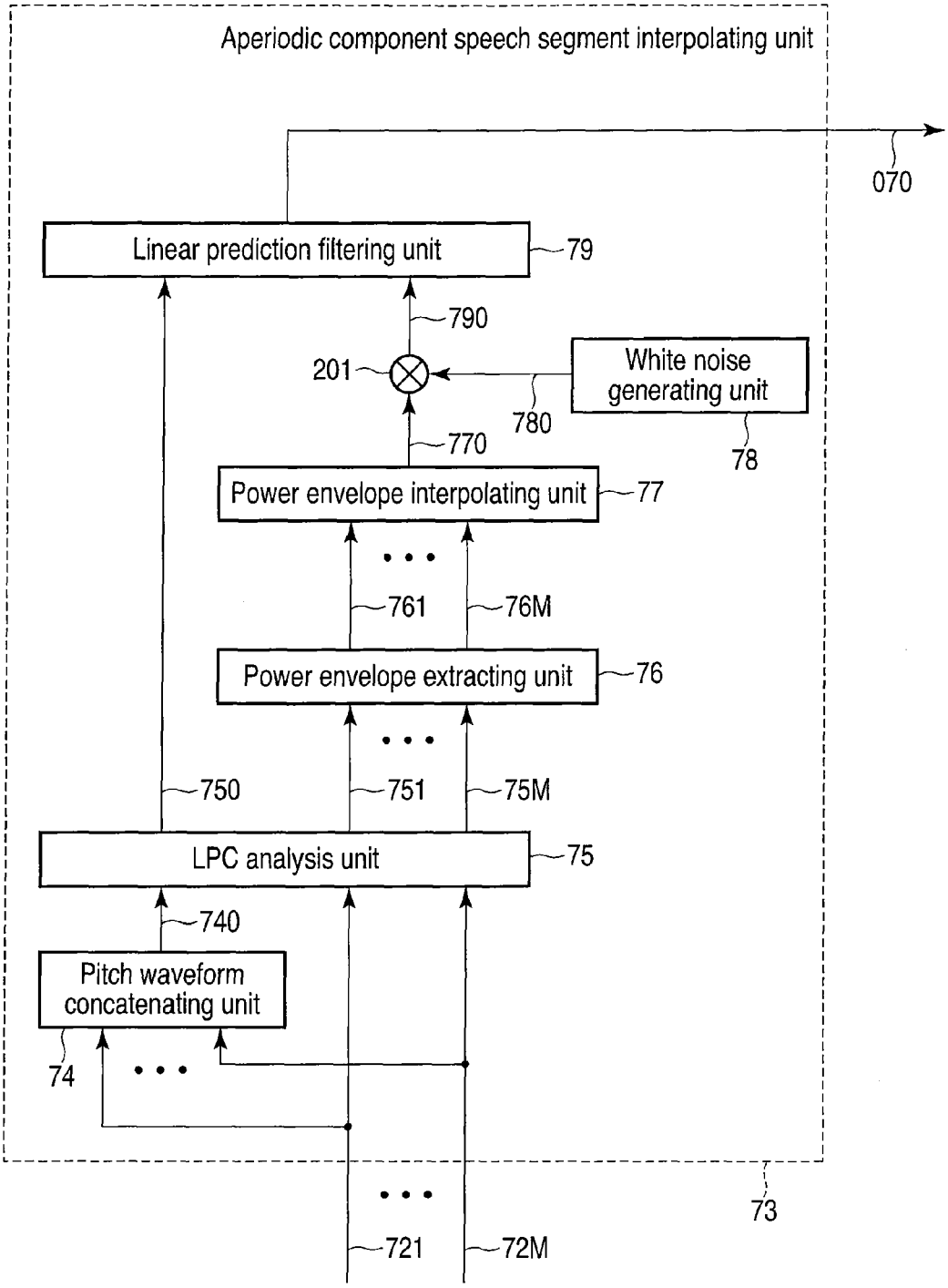
FIG. 19 is a block diagram showing the internal arrangement of an aperiodic component speech segment interpolating unit in FIG. 18.

The aperiodic component speech segment interpolating unit 73 interpolates the aperiodic component pitch waveforms 721, . . . , 72M at interpolation ratios, and inputs the aperiodic component pitch waveform 070 of interpolated speaker's speech to the adder 103. As shown in FIG. 19, the aperiodic component speech segment interpolating unit 73 includes a pitch waveform concatenating unit 74, LPC analysis unit 75, power envelope extracting unit 76, power envelope interpolating unit 77, white noise generating unit 78, multiplier 201, and linear prediction filtering unit 79.

The pitch waveform concatenating unit 74 concatenates the aperiodic component pitch waveforms 721, . . . , 72M along the time axis, obtaining a concatenated aperiodic component pitch waveform 740. The pitch waveform concatenating unit 74 inputs the concatenated aperiodic component pitch waveform 740 to the LPC analysis unit 75.

The LPC analysis unit 75 performs LPC analysis for the aperiodic component pitch waveforms 721, . . . , 72M and the concatenated aperiodic component pitch waveform 740. The LPC analysis unit 75 obtains LPC coefficients 751, . . . , 75M for the respective aperiodic component pitch waveforms 721, . . . , 72M, and an LPC coefficient 750 for the concatenated aperiodic component pitch waveform 740. The LPC analysis unit 75 inputs the LPC coefficient 750 to the linear prediction filtering unit 79, and inputs the LPC coefficients 751, . . . , 75M to the power envelope extracting unit 76.

The power envelope extracting unit 76 generates M linear prediction residual waveforms based on the respective LPC coefficients 751, . . . , 75M. The power envelope extracting unit 76 extracts power envelopes 761, . . . , 76M from the respective linear prediction residual waveforms. The power envelope extracting unit 76 inputs the power envelopes 761, . . . , 76M to the power envelope interpolating unit 77.

The power envelope interpolating unit 77 aligns the power envelopes 761, . . . , 76M along the time axis so as to maximize the correlation between them, and interpolates them at interpolation ratios, generating an interpolated power envelope 770. The power envelope interpolating unit 77 inputs the interpolated power envelope 770 to the multiplier 201.

The white noise generating unit 78 generates white noise 780 and inputs it to the multiplier 201. The multiplier 201 multiplies the white noise 780 by the interpolated power envelope 770. By multiplying the white noise 780 by the interpolated power envelope 770, the amplitude of the white noise 780 is modulated, obtaining a sound source waveform 790. The multiplier 201 inputs the sound source waveform 790 to the linear prediction filtering unit 79.

The linear prediction filtering unit 79 performs linear prediction filtering processing for the sound source waveform 790 using the LPC coefficient 750 as a filter coefficient, and generates the aperiodic component pitch waveform 070 of interpolated speaker's speech.

As described above, the speech synthesis apparatus according to the third embodiment performs different interpolation processes for the periodic and aperiodic components of speech. Thus, the speech synthesis apparatus according to the third embodiment can perform more appropriate interpolation than those in the first and second embodiments, improving the naturalness of interpolated speech.

Fourth Embodiment

In the speech synthesis apparatus according to one of the first to third embodiments, the formant mapping unit 43 adopts equation (2) as a cost function. In a speech synthesis apparatus according to the fourth embodiment, a formant mapping unit 43 utilizes a different cost function.

The vocal tract length generally differs between speakers, and there is an especially large difference according to the gender of the speaker. For example, it is known that the formant of a male voice tends to appear in the low-frequency side, compared to that of a female voice. Even for the same gender, particularly for the male, the formant of an adult voice tends to appear in the low-frequency side, compared to that of a child voice. In this way, if speaker's parameters have a difference in formant frequency owing to the difference in vocal tract length, mapping processing may become difficult. For example, the high-frequency formant of a female speaker's parameter may not correspond to that of a male speaker's parameter at all. In this case, even if an uncorresponded formant is used as an interpolated speaker's parameter, like the second embodiment, interpolated speech with a desired voice quality (e.g., neutral speech) may not always be obtained. More specifically, incoherent speech is synthesized as if not one speaker but two speakers spoke.

To prevent this, in the speech synthesis apparatus according to the fourth embodiment, the formant mapping unit 43 employs the following equation (17) as a cost function:

$$C_{XY}(x,y)=w_\omega\cdot(f(\omega_X{}^x)-\omega_Y{}^y)^2+w_a\cdot(\log a_X{}^x-\log a_Y{}^y)^2 \quad (17)$$

The function f(ω) in equation (17) is given by, for example, $$f(\omega_X{}^x)=\alpha\cdot\omega_X{}^x \quad (18)$$

where α is a vocal tract length normalization coefficient for compensating for the difference in vocal tract length between speakers X and Y (normalizing the vocal tract length). In equation (18), α is desirably set to a value equal to or smaller than "1" when, for example, speaker X is a female and speaker Y is a male. The function f(ω) in equation (17) may be not a linear control function as represented by equation (18) but a nonlinear control function.

Figure 20A:
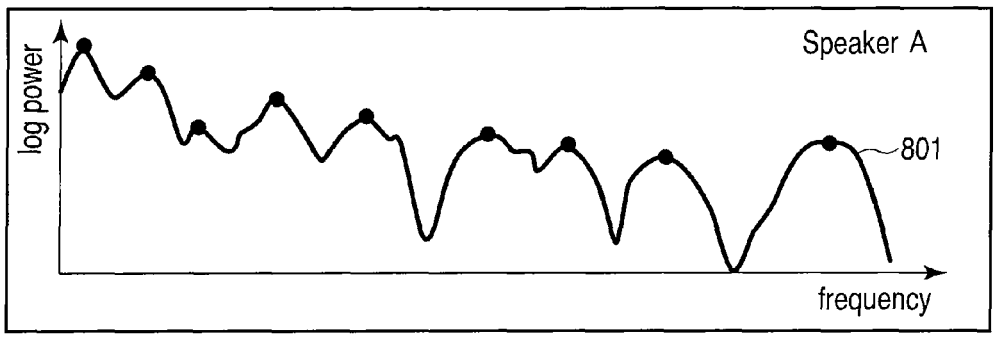
FIG. 20A is a graph showing an example of the log power spectrum of a pitch waveform corresponding to speaker A.
Figure 20B:
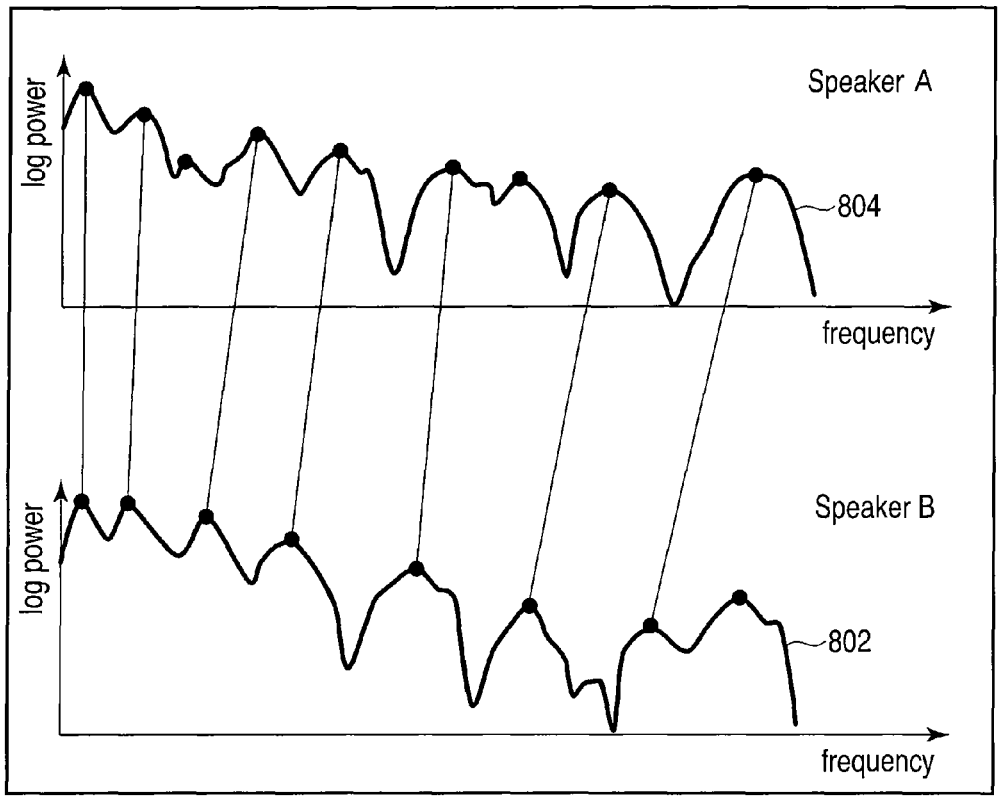
FIG. 20B is a view showing the formant correspondence between speakers A and B when the frequency of the log power spectrum in FIG. 20A is adjusted.

Applying the function f(ω) in equation (18) to a log power spectrum 801 of the pitch waveform of speaker A shown in FIG. 20A yields a log power spectrum 803 shown in FIG. 20B. Applying the function f(ω) to the log power spectrum 801 is equivalent to stretching/contracting the log power spectrum 801 along the frequency axis. By stretching/contracting the log power spectrum 801 along the frequency axis, the difference in vocal tract length between speakers A and B is compensated for. The formant mapping unit 43 can, therefore, properly map formants between the speaker's parameters of speakers A and B. More specifically, in FIG. 20B, the formant mapping unit 43 obtains a mapping result 431 indicating a correspondence as represented by lines which connect formants (indicated by black dots) contained in a log power spectrum 802 of the pitch waveform of speaker B and formants (indicated by black dots) contained in the log power spectrum 803.

As described above, the speech synthesis apparatus according to the fourth embodiment controls the formant frequency so as to compensate for the difference in vocal tract length between speakers, and then makes formants correspond to each other. Even when speakers have a large difference in vocal tract length, the speech synthesis apparatus according to the fourth embodiment appropriately makes formants correspond to each other and can synthesize high-quality (coherent) interpolated speech.

Fifth Embodiment

In the speech synthesis apparatus according to one of the first to fourth embodiments, the formant mapping unit 43 adopts equation (2) or (17) as a cost function. In a speech synthesis apparatus according to the fifth embodiment, a formant mapping unit 43 uses a different cost function.

In general, the average value of the log formant power differs between speaker's parameters owing to factors such as the individual difference of each speaker and the speech recording environment. If speaker's parameters have a difference in the average value of the log formant power, mapping processing may become difficult. For example, assume that the average value of the log power in the speaker's parameter of speaker X is smaller than that of the log power in the speaker's parameter of speaker Y. In this case, a formant having a relatively large formant power in the speaker's parameter of speaker X may be made to correspond to a formant having a relatively small formant power in the speaker's parameter of speaker Y. In contrast, a formant having a relatively small formant power in the speaker's parameter of speaker X and a formant having a relatively large formant power in the speaker's parameter of speaker Y may not correspond to each other at all. In this case, interpolated speech with a desired voice quality (voice quality expected based on the interpolation ratio) may not always be obtained.

Considering this, in the speech synthesis apparatus according to the fifth embodiment, the formant mapping unit 43 utilizes the following equation (19) as a cost function:

$$C_{XY}(x,y)=w_\omega\cdot(\omega_X^x-\omega_Y^y)^2+w_a\cdot(g(\log a_X^x)-\log a_Y^y)^2 \tag{19}$$

The function g(log a) in equation (19) is given by, for example, $$g(\log a_X^x)=\log a_X^x+\frac{\sum \log a_Y^y}{N_Y}-\frac{\sum \log a_X^x}{N_X} \tag{20}$$

In equation (20), the second term of the right-hand side indicates the average value of the log formant power in the speaker's parameter of speaker Y, and the third term indicates that of the log formant power in the speaker's parameter of speaker X. That is, equation (20) compensates for the power difference between speakers (normalizes the formant power) by reducing the difference in the average value of the log formant power between speakers X and Y. Note that the function g(log a) in equation (19) may be not a linear control function as represented by equation (20) but a nonlinear control function.

Figure 21A:
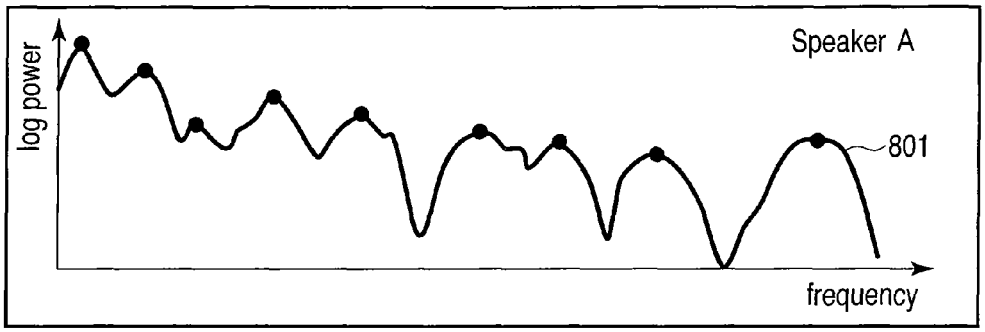
FIG. 21A is a graph showing an example of the log power spectrum of a pitch waveform corresponding to speaker A.
Figure 21B:
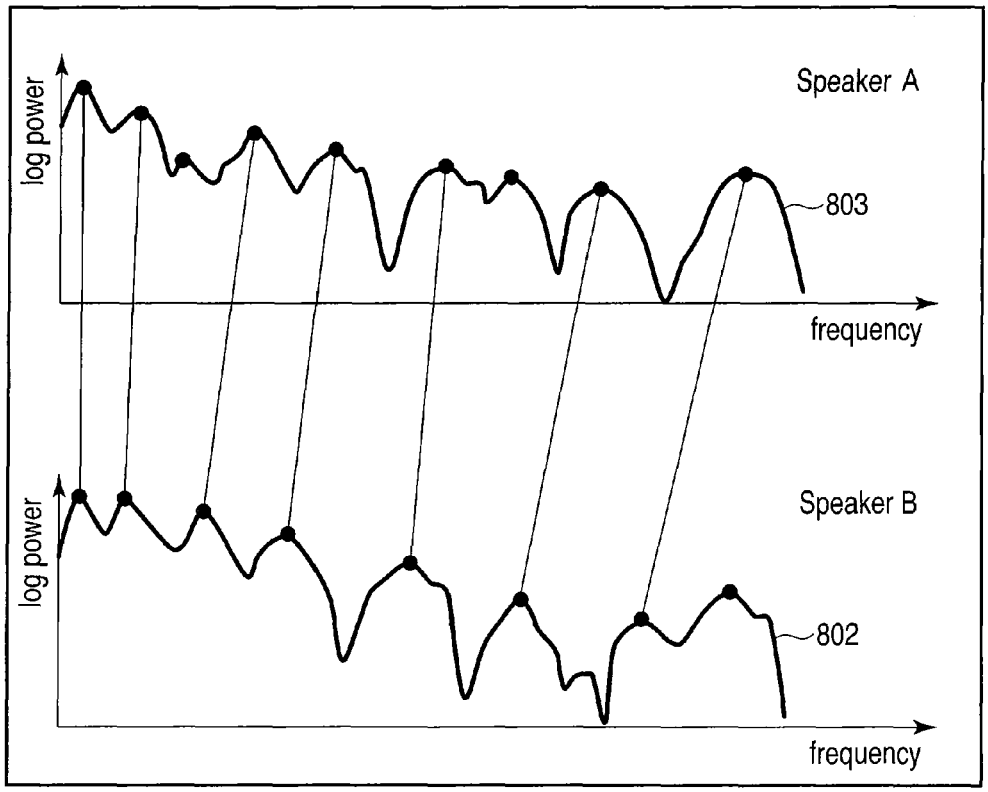
FIG. 21B is a view showing the formant correspondence between speakers A and B when the power of the log power spectrum in FIG. 21A is adjusted.

Applying the function g(log a) in equation (20) to a log power spectrum 801 of the pitch waveform of speaker A shown in FIG. 21A yields a log power spectrum 804 shown in FIG. 21B. Applying the function g(log a) to the log power spectrum 801 is equivalent to translating the log power spectrum 801 along the log power axis. By translating the log power spectrum 801 along the log power axis, the difference in the average value of the log formant power between the parameters of speakers A and B is reduced. The formant mapping unit 43 can properly map formants between the speaker's parameters of speakers A and B. More specifically, in FIG. 21B, the formant mapping unit 43 obtains a mapping result 431 indicating a correspondence as represented by lines which connect formants contained in a log power spectrum 802 and formants (indicated by black dots) contained in the power spectrum 804.

As described above, the speech synthesis apparatus according to the fifth embodiment controls the log formant power so as to reduce the difference in the average value of the log formant power between speaker's parameters, and then makes formants correspond to each other. Even when speaker's parameters have a large difference in the average value of the log formant power, the speech synthesis apparatus according to the fifth embodiment appropriately makes formants correspond to each other and can synthesize interpolated speech with high quality (almost voice quality expected based on the interpolation ratio).

Sixth Embodiment

Figure 22:
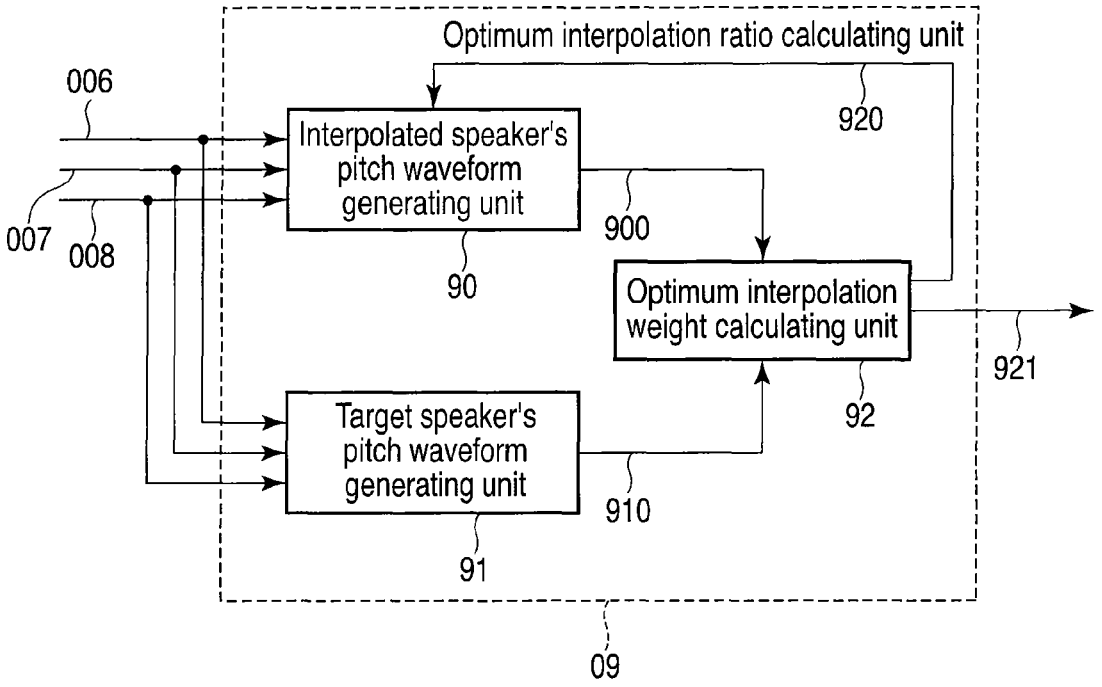
FIG. 22 is a block diagram showing the optimum interpolation ratio calculating unit of a speech synthesis apparatus according to the sixth embodiment.

A speech synthesis apparatus according to the sixth embodiment calculates, by the operation of an optimum interpolation ratio calculating unit 09, an optimum interpolation ratio 921 at which interpolated speaker's speech to be synthesized according to one of the first to fifth embodiments comes close to a specific target speaker's speech. As shown in FIG. 22, the optimum interpolation ratio calculating unit 09 includes an interpolated speaker's pitch waveform generating unit 90, target speaker's pitch waveform generating unit 91, and optimum interpolation weight calculating unit 92.

The interpolated speaker's pitch waveform generating unit 90 generates an interpolated speaker's pitch waveform 900 corresponding to interpolated speech, based on a pitch pattern 006, a phoneme duration 007, a phoneme symbol sequence 008, and an interpolation ratio designated by an interpolation weight vector 920. The arrangement of the interpolated speaker's pitch waveform generating unit 90 may be the same as or similar to that of, e.g., the pitch waveform generating unit 04 shown in FIG. 3. Note that the interpolated speaker's pitch waveform generating unit 90 does not use the speaker's parameter of a target speaker when generating the interpolated speaker's pitch waveform 900.

The interpolation weight vector 920 is a vector containing, as a component, an interpolation ratio (interpolation weight) applied to each speaker's parameter when the interpolated speaker's pitch waveform generating unit 90 generates the interpolated speaker's pitch waveform 900. For example, the interpolation weight vector 920 is given by $$s=(s_1,s_2,\ldots,s_m,\ldots,s_{M-1},s_M) \quad (21)$$

where s (left-hand side) is the interpolation weight vector 920. Each component of the interpolation weight vector 920 satisfies $$\Sigma_{m=1}^{M} s_m=1 \quad (22)$$

Based on the pitch pattern 006, the phoneme duration 007, the phoneme symbol sequence 008, and the speaker's parameter of a target speaker, the target speaker's pitch waveform generating unit 91 generates a target speaker's pitch waveform 910 corresponding to a target speaker's speech. The arrangement of the target speaker's pitch waveform generating unit 91 may be the same as or different from that of, e.g., the pitch waveform generating unit 04 shown in FIG. 3. When the target speaker's pitch waveform generating unit 91 has the same arrangement as that of the pitch waveform generating unit 04 shown in FIG. 3, it suffices to set "1" as the number of speaker's parameters selected by a speaker's parameter selecting unit in the target speaker's pitch waveform generating unit 91, and fix a selected speaker's parameter to a target speaker's one (alternatively, an interpolation ratio $s_T$ for the target speaker may be set to "1" without particularly limiting the number of selected speaker's parameters).

The optimum interpolation weight calculating unit 92 calculates the similarity between the spectrum of the interpolated speaker's pitch waveform 900 and that of the target speaker's pitch waveform 910. More specifically, the optimum interpolation weight calculating unit 92 calculates, for example, the correlation between these two spectra. The optimum interpolation weight calculating unit 92 feedback-controls the interpolation weight vector 920 so as to increase the similarity. The optimum interpolation weight calculating unit 92 updates the interpolation weight vector 920 based on the calculated similarity, and supplies the new interpolation weight vector 920 to the interpolated speaker's pitch waveform generating unit 90. The optimum interpolation weight calculating unit 92 outputs, as the optimum interpolation ratio 921, an interpolation weight vector 920 obtained when the similarity converges. Note that the similarity convergence condition may be determined arbitrarily based on the design/experiment. For example, when variations of the similarity fall within a predetermined range, or when the similarity becomes equal to or higher than a predetermined threshold, the optimum interpolation weight calculating unit 92 may determine that the similarity has converged.

As described above, the speech synthesis apparatus according to the sixth embodiment calculates an optimum interpolation ratio for obtaining interpolated speech which imitates a target speaker's speech. Even if there are only a small number of speaker's parameters of a target speaker, the speech synthesis apparatus according to the sixth embodiment can utilize interpolated speech which imitates the target speaker's speech, and thus can synthesize speech sounds with various voice qualities from a small number of speaker's parameters.

For example, a program for carrying out the processing in each of the above embodiments can also be provided by storing it in a computer-readable storage medium. The storage medium can take any storage format as long as it can store a program and is readable by a computer, like a magnetic disk, an optical disc (e.g., CD-ROM, CD-R, or DVD), a magneto-optical disk (e.g., MO), or a semiconductor memory.

The program for carrying out the processing in each of the above embodiments may be provided by storing it in a computer connected to a network such as the Internet, and downloading it via the network.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech synthesis apparatus comprising:

a selecting unit configured to select speaker's parameters, of a plurality of speakers, one by one for respective speakers and obtain a plurality of speakers' parameters, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms;

a mapping unit configured to use a cost function to assess a weighted sum of a difference between the formant frequencies and a difference between the formant powers, to determine formants of the plurality of speakers' parameters that correspond to each other;

a generating unit configured to generate an interpolated speaker's parameter by interpolating, in accordance with desired interpolation ratios, the formant frequencies, formant phases, formant powers, and window functions of the formants of the plurality of speakers' parameters that correspond to each other; and a synthesizing unit configured to synthesize a pitch waveform corresponding to interpolated speaker's speech sounds based on the interpolation ratios using the interpolated speaker's parameter.

2. The apparatus according to claim 1, wherein the generating unit inserts, into the interpolated speaker's parameter, a formant frequency, a formant phase, a formant power, and a window function concerning a formant which is not corresponded to other formants.

3. The apparatus according to claim 1, wherein the speaker's parameters are prepared for respective pitch waveforms corresponding to periodic components of speaker's speech sounds, the synthesizing unit synthesizes a pitch waveform corresponding to a periodic component of the interpolated speaker's speech sound using the interpolated speaker's parameter, and the apparatus further comprises a second selecting unit configured to select, one by one for respective speakers, pitch waveforms corresponding to aperiodic components of the speaker's speech sounds and obtain a plurality of pitch waveforms, a second generating unit configured to generate a pitch waveform corresponding to an aperiodic component of the interpolated speaker's speech sound by interpolating the plurality of pitch waveforms at the interpolation ratios, and a second synthesizing unit configured to synthesize the pitch waveform corresponding to the periodic component of the interpolated speaker's speech sound and the pitch waveform corresponding to the aperiodic component of the interpolated speaker's speech sound, and obtain the pitch waveform corresponding to the interpolated speaker's speech sound.

4. The apparatus according to claim 1, wherein the mapping unit applies, to the formant frequencies, a function for compensating for a difference in vocal tract length between speakers, and then makes formants correspond to each other between the plurality of speakers' parameters using the cost function.

5. The apparatus according to claim 1, wherein the mapping unit applies, to the formant powers, a function for compensating for a difference in power between speakers, and then makes formants correspond to each other between the plurality of speakers' parameters using the cost function.

6. The apparatus according to claim 1, further comprising:

a second generating unit configured to generate a pitch waveform corresponding to a target speaker's speech sound; and a calculating unit configured to calculate an optimum interpolation ratio for obtaining the target speaker's speech sound based on the plurality of speakers' parameters, by performing, for the interpolation ratios, feedback control of making the pitch waveform corresponding to the interpolated speaker's speech sound come close to the pitch waveform corresponding to the target speaker's speech sound.

7. The apparatus according to claim 1, wherein the interpolation ratio is a ratio assigned to the speaker's parameter.

8. A non-transitory computer readable storage medium storing instructions of a computer program which when executed by a computer results in performance of steps comprising:

selecting speaker's parameters, of a plurality of speakers, one by one for respective speakers and obtaining a plurality of speakers' parameters, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms;

using a cost function to assess a weighted sum of a difference between the formant frequencies and a difference between the formant powers, to determine formants of the plurality of speakers' parameters that correspond to each other;

generating an interpolated speaker's parameter by interpolating, at desired interpolation ratios, the formant frequencies, formant phases, formant powers, and window functions of formants of the plurality of speakers' parameters that correspond to each other; and synthesizing a pitch waveform corresponding to interpolated speaker's speech sounds based on the interpolation ratios using the interpolated speaker's parameter.

9. The non-transitory computer readable storage medium according to claim 8, wherein the speaker's parameters being prepared for respective pitch waveforms correspond to periodic components of the speaker's speech sounds and correspond to aperiodic components of the speaker's speech sounds; and wherein the step of synthesizing the pitch waveform comprises synthesizing the pitch waveform to correspond to the periodic components and a pitch waveform corresponding to the aperiodic components of the interpolated speaker's speech sounds based on the interpolation ratios using the interpolated speaker's parameter.

10. A speech synthesis method comprising:

selecting speaker's parameters, of a plurality of speakers, one by one for respective speakers and obtaining a plurality of speakers' parameters, by a selecting unit, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms;

using a cost function to assesses a weighted sum of a difference between the formant frequencies and a difference between the formant powers, to determine formants of the plurality of speakers' parameters that correspond to each other, by a mapping unit;

generating an interpolated speaker's parameter by interpolating, at desired interpolation ratios, the formant frequencies, formant phases, formant powers, and window functions of formants of the plurality of speakers' parameters that correspond to each other, by a generating unit; and synthesizing a pitch waveform corresponding to interpolated speaker's speech sounds based on the interpolation ratios using the interpolated speaker's parameter, by a synthesis unit.

11. The speech synthesis method according to claim 10, wherein the speaker's parameters being prepared for respective pitch waveforms correspond to periodic components of a speaker's speech sounds and aperiodic components of the speaker's speech sounds; and wherein the step of synthesizing the pitch waveform comprises synthesizing the pitch waveform corresponding to the periodic and aperiodic components of the interpolated speaker's speech sounds based on the interpolation ratios using the interpolated speaker's parameter, by a synthesis unit.

12. A speech synthesis apparatus comprising:

a selecting unit configured to select speaker's parameters one by one for respective speakers and obtain a plurality of speakers' parameters, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms;

a mapping unit configured to make formants correspond to each other between the plurality of speakers' parameters using a cost function based on the formant frequencies and the formant powers;

a generating unit configured to generate an interpolated speaker's parameter by interpolating, in accordance with desired interpolation ratios, the formant frequencies, formant phases, formant powers, and window functions of the formants which are made to correspond to each other;

a synthesizing unit configured to synthesize a pitch waveform corresponding to interpolated speaker's speech sounds based on the interpolation ratios using the interpolated speaker's parameter;

a second selecting unit configured to select, one by one for respective speakers, pitch waveforms corresponding to aperiodic components of the speaker's speech sounds and obtain a plurality of pitch waveforms;

a second generating unit configured to generate a pitch waveform corresponding to an aperiodic component of the interpolated speaker's speech sound by interpolating the plurality of pitch waveforms at the interpolation ratios; and a second synthesizing unit configured to synthesize the pitch waveform corresponding to the periodic component of the interpolated speaker's speech sound and the pitch waveform corresponding to the aperiodic component of the interpolated speaker's speech sound, and obtain the pitch waveform corresponding to the interpolated speaker's speech sound.

13. A speech synthesis apparatus comprising:

a selecting unit configured to select speaker's parameters one by one for respective speakers and obtain a plurality of speakers' parameters, the speaker's parameters being prepared for respective pitch waveforms corresponding to speaker's speech sounds, the speaker's parameters including formant frequencies, formant phases, formant powers, and window functions concerning respective formants that are contained in the respective pitch waveforms;

a mapping unit configured to make formants correspond to each other between the plurality of speakers' parameters using a cost function based on the formant frequencies and the formant powers;

a generating unit configured to generate an interpolated speaker's parameter by interpolating, in accordance with desired interpolation ratios, the formant frequencies, formant phases, formant powers, and window functions of the formants which are made to correspond to each other;

a synthesizing unit configured to synthesize a pitch waveform corresponding to interpolated speaker's speech sounds based on the interpolation ratios using the interpolated speaker's parameter;

a second generating unit configured to generate a pitch waveform corresponding to a target speaker's speech sound; and a calculating unit configured to calculate an optimum interpolation ratio for obtaining the target speaker's speech sound based on the plurality of speakers' parameters, by performing, for the interpolation ratios, feedback control of making the pitch waveform corresponding to the interpolated speaker's speech sound come close to the pitch waveform corresponding to the target speaker's speech sound.

* * * * *